US006148456A

United States Patent [19]

Tharalson et al.

[11] Patent Number: 6,148,456

[45] Date of Patent: Nov. 21, 2000

[54] MULTI-LEVEL MULTIPLE PURPOSE CONVERTIBLE PLAYPEN

[76] Inventors: Douglas Tharalson; Diana Tharalson, both of 29995 Mulholland Hwy., Agoura, Calif. 91301; Bruce Martin, 27162 Sea Vista Dr., Malibu, Calif. 90265

[21] Appl. No.: 09/552,331

[22] Filed: Apr. 19, 2000

[51] Int. Cl.[7] ..... A47D 7/02

[52] U.S. Cl. ..... 5/99.1; 5/11; 5/95; 5/98.1

[58] Field of Search ..... 5/99.1, 95, 98.1, 5/93.1, 93.2, 97, 655, 11

[56] References Cited

U.S. PATENT DOCUMENTS

| | | | |
|---|---|---|---|
| 4,538,309 | 9/1985 | Gunter | 5/98.1 |
| 5,172,435 | 12/1992 | Griffin et al. | 5/95 |
| 5,581,827 | 12/1996 | Fong et al. | 5/98.1 |
| 5,845,349 | 12/1998 | Tharalson et al. | 5/99.1 |

*Primary Examiner*—Alexander Grosz
*Attorney, Agent, or Firm*—David A. Belasco; William H. Pavitt; Beehler & Pavitt

[57] ABSTRACT

A first playpen enclosure that converts easily to a bassinet, changing table or bed-side crib or "co-sleeper" that attaches securely to the parents' bed. A second enclosure support system maintains a padded enclosure and rigid floor panel at one or more predetermined levels below the top of the playpen to form the bassinet and co-sleeper. The second enclosure has a back, two sides, a bottom and a front flap that converts into a front wall for use in the bassinet mode and overhangs the front horizontal rail for use in the co-sleeper mode. The upper front corners are segmented into a movable section and a fixed section to facilitate lowering the front horizontal rail to at least one lower second position to accommodate various parental bed heights. Extensions of the fixed section are affixed to the front vertical rails and accept the movable sections in several positions to secure the rail in the second positions. The support means, padded enclosure and rigid floor panel complete the changing table with the edges of the front flap secured to the edges of the side walls. The playpen is placed adjacent the parents' bed for use as a co-sleeper. Means are provided to secure loose flap material to the front of the co-sleeper. For co-sleeper use, reinforcing straps secure the unit to the parents's bed and prevent movement. The unit is easily folded with its components into a compact carring case for transport or storage. The first playpen enclosure comprises a floor panel with a floor reinforcing panel substantially coextensive with the floor panel, fixedly attached thereto, and having fastening portions that attach it to a rigid enclosure part of the first playpen enclosure.

43 Claims, 16 Drawing Sheets

MULTI-LEVEL MULTIPLE PURPOSE CONVERTIBLE PLAYPEN

RELATED APPLICATIONS

This application is related to U.S. Pat. No. 5,845,349, issued Dec. 8, 1998.

FIELD OF INVENTION

The instant invention relates to the field of convertible units for use with babies and very young children; in particular to units which may be easily converted to a playpen, a bassinet, changing table, or child's bed-side sleeping enclosure, hereinafter referred to for convenience as a "co-sleeper", that attaches securely to the parents' bed.

BACKGROUND OF THE INVENTION

Play yards and playpens for babies and young children are well known and many variations have been marketed over the years. Low portable cribs have also been used as playpens. For reasons of economy and space conservation it has been practical to find additional uses for playpens, such as bassinets and changing tables if such additional uses can be accomplished by means of easy alterations or adjustments that are reversible.

In U.S. Pat. No. 2,548,769, Burgin teaches a crib that can be lowered for use as a playpen. Shamie, in U.S. Pat. No. 5,339,479 teaches a portable playpen that can be converted to a changing table by adding an upper level using zippers to hold the upper floor in place. Several levels of zipper teeth provide different height for the upper floor. In U.S. Pat. No. 5,553,336, Mariol adds an upper level to a playpen to provide a bassinet. The short legs of the upper level are inserted into openings in the top of the vertical supports of the playpen. Saldana, U.S. Pat. No. 2,691,176, teaches a unit designed for home and travel that may be used as a support for a playpen, bassinet or baby chair. U.S. Pat. No. 5,581,827 to Fong et al. discloses a foldable playpen unit.

Beside cribs that attached to the parents' bed were known at the turn of the century (U.S. Pat. Nos. 5,548,005; 620,069; 1,138,45 1; 1,283,169; 1,267,244) but fell out of favor for many years. Recently there has been resurgence in the practice of having babies sleep adjacent the parents' bed. Such bed-side cribs are taught in U.S. Pat. No. 5,172,435 to Griffin et al.; U.S. Pat. No. 5,293,655 to Van Winkle et al. and to the present inventors, Tharalson et al. as U.S. Pat. No. 5,148,561.

It is an objective of the present invention to provide a single unit that with quick and easy adjustments can be adapted for several different purposes, including a playpen, a bassinet, a changing table and a co-sleeper.

It is another objective of the present invention to provide a unit that can be converted to a co-sleeper that is an improvement over the prior art, that rests on four legs, will not lift, tip or buck and that is secured to the parents' bed with a safety strap so it cannot slide away from the bed.

It is a further objective to provide a co-sleeper that is adaptable to both U.S. and European bed heights, including means of securing the co-sleeper to beds of both heights. Means should be provided to permit the co-sleeper mattress to be positioned at heights within the co-sleeper suitable for positioning adjacent both U.S. and European bed surfaces. Likewise, means for adjusting the mattress cover to minimize any excess fabric when switching between U.S. and European mattress height adjustments should be provided.

Another objective of the present invention is to allow conversion to a co-sleeper while still maintaining the stability of the unit by the repositioning of the front horizontal rail. Such repositioning should provide for both U.S. and European bed heights.

It is yet a further objective of the present invention that the co-sleeper be adjacent the parents' bed but at a level below the level of the parents' bed and with a fabric extension covering the separation so there is no chance of the baby being injured. Another objective of the present invention is to provide means to adjust the height of the co-sleeper to conform to the different bed heights. A still further objective of the present invention is to provide a secure washable enclosure for the baby.

Another objective of the present invention is to provide a playpen in which a baby can be tended by a care-giver that is physically handicapped. A further objective of the present invention is to provide a unit that folds easily for storage and transport.

It is still a further objective of the invention to provide a playpen with a floor which can withstand repeated jumping and rough play by an infant or small child without sagging or the risk of breakage. The floor should be constructed of a mesh material to prevent accidental suffocation of an infant or small child who might find his or her way underneath the co-sleeper mattress.

It is yet a further objective to provide an easily convertible playpen that includes strong, secure hinging mechanisms for the playpen support members. Such mechanisms should lock the members securely in place and yet be simple and easy to release when required.

It is still a further objective of the invention to provide for simple adjustments to the height of the front wall of the co-sleeper while preventing injury to any small fingers that may be inserted into openings in the adjustment mechanism.

It is another objective to minimize any loose fabric associated with the co-sleeper mattress that could conceivably cause asphyxiation of an infant or small child.

It is still another objective of the invention to provide for increased structural strength of the co-sleeper while adding an attractive design feature by including a detachable canopy cover for the invention.

Other features and advantages of the invention will be seen from the following description and drawings.

SUMMARY OF THE INVENTION

The present invention is a playpen convertibly adapted for use as a bassinet, changing table and co-sleeper. The playpen includes a rigid first enclosure with an open top, a floor, a front wall, a back wall, a first side wall and a second side wall. The enclosure is of a first predetermined height and has a rigid frame.

The frame is formed at the top by front and rear upper parallel horizontal rails, first and second upper side horizontal rails, two upper front corner members and two upper rear corner members in cooperation with them. The frame is formed adjacent the floor by front and rear lower parallel horizontal rails, first side and second side lower parallel horizontal rails and four lower corner leg members in cooperation with them. A pair of front vertical rails and a pair of rear vertical rails are in further cooperation with the two upper front corner members, the two upper rear corner members and the four lower corner leg members. The rigid frame supports the floor, the front wall, the back wall, the first side wall and the second side wall.

The floor further includes a floor panel attached to the front, back, first side and second side walls. The floor panel has a top surface and a bottom surface. A floor-reinforcing panel is provided. The reinforcing panel has substantially the same planar dimensions as the floor panel and has an upper surface, a lower surface, a perimeter and at least four fastening portions extending outwardly from the perimeter. The reinforcing panel is fixedly attached at its upper surface to the bottom surface of the floor panel. The fastening portions are fixedly attached to each of the front and rear lower parallel horizontal rails and to the first and second side lower parallel horizontal rails.

Each upper front corner member is constructed of two reversibly separable complementary sections. The first of these sections is fixedly attached to an end of the front upper horizontal rail and the second of these sections is fixedly attached to the upper end of one of the front vertical rails. The upper front corner members support the upper front horizontal rail in its first position.

Receiving means are fixedly attached to each front vertical rail for receiving the first section of an upper front corner member and reversibly maintaining the upper front horizontal rail in at least one lower, second position, thereby maintaining structural rigidity of the playpen when the upper front horizontal rail is in one of the second positions.

A second enclosure is provided. The second enclosure is sized to fit substantially within the first enclosure and has an open top, a back wall, a front wall, first and second side walls and a bottom. Means are provided for removably supporting the second enclosure within the first enclosure at at least one predetermined distance from the top of the first enclosure.

A securing strap assembly for securing to a parental bed is provided, along with at least one pair of alignment means through which the securing strap assembly is directed. These alignment means maintain the securing strap assembly in horizontal orientation and preventing lifting or bucking of the playpen when used as a co-sleeper. At least one pair of attachment means for fastening the securing strap assembly to the playpen is provided.

The playpen is ready for use as a co-sleeper when the upper front horizontal rail is in one of the second positions, the second enclosure is supported by the second enclosure support means, the securing strap assembly is directed through one of the alignment means, fastened to one of the attachment means and is properly positioned and secured to the parental bed.

In a variant of the invention, the means for removably supporting the second enclosure within the first enclosure at at least one predetermined distance from the top of the first enclosure further includes first, second, third and fourth support hangers. Each of the support hangers has a first end, a second end, an inner side and an outer side. Each of the support hangers has a curved hooking portion located at the first end.

The hooking portion is sized and shaped to fit frictionally over the first enclosure and one of the first and second upper side horizontal rails. Each of the support hangers further includes at least two circular orifices. The orifices extend from the inner side to the outer side of the hangers. The hangers also include at least two spring button housings. The housings are located on the outer sides of the support hangers adjacent to the orifices. Each of the spring button housings includes a finger opening.

Two support rods are provided. Each of the rods has a first end and a second end. The rods are sized and shaped to extend between one of the first and second support hangers and one of the third and fourth support hangers when the support hangers are located on the first enclosure and one of the first and second upper side horizontal rails. Each of the support rods has a spring button mounted at the first end and the second end. The spring button is sized and shaped to engage the spring button housing.

When the first and second ends of the support rods are introduced into the orifices of the support hangers, and the support hangers are located on the first enclosure and one of the first and second upper side horizontal rails, the spring buttons will removably engage the spring button housings of the hangers, thereby providing a support platform for the second enclosure.

In another variant of the invention, the rigid frame further includes means for pivotally mounting the front and rear upper horizontal rails to the upper front corner members and upper rear corner members, respectively. Frame locking devices are pivotally mounted at center points of the front and rear upper horizontal rails. These devices permit the upper rails to pivot downwardly from the open top of the first enclosure.

Means are provided for pivotally mounting the first and second upper side horizontal rails to the upper front and rear corner members. Frame pivoting devices are pivotally mounted at center points of the first and second upper side horizontal rails. These devices permit each of the rails to pivot downwardly from the open top of the first enclosure. Means are provided for pivotally mounting the first side and second side lower horizontal rails to the lower front and rear corner members.

Frame pivoting devices are pivotally mounted at center points of the first and second side lower horizontal rails, permitting each of the rails to pivot upwardly from the floor of the first enclosure. Means are provided for pivotally mounting the front and rear lower horizontal rails to the lower front and rear corner members, respectively. Frame pivoting devices are pivotally mounted at center points of the front and rear lower horizontal rails. These devices permit each of the rails to pivot upwardly from the floor of the first enclosure.

In use, the frame may be quickly folded into a compact package for transport and storage by releasing the locking devices positioned on the upper front and rear horizontal rails and depressing the upper horizontal rails downwardly while pulling upwardly on a handle attached to the floor. This causes the upper and lower side horizontal rails and front and rear lower horizontal rails to bend upwardly and the vertical rails to move inwardly.

In a further variant of the invention, the floor further includes at least four reinforcing straps. The straps have first and second ends and are fixedly attached to the lower surface of the reinforcing panel. Two of the straps are secured at their first and second ends to each of the front and rear lower horizontal rails, respectively and two of the straps are secured at their first and second ends to each of the first and second side lower horizontal rails, respectively. Four padded covers are provided. The covers are fixedly attached to the floor panel and at least one of the fastening portions to protect the frame pivoting devices attached to the front and rear lower horizontal rails and those attached to the first side and second side lower horizontal rails.

A flexible loop is provided. The loop is fixedly attached to a central portion of the top surface of the floor panel and provides a handle for lifting the floor. A hollow leg member is affixed to a central portion of the lower surface of the reinforcing panel to provide support for it.

In yet a further variant of the invention, the second enclosure is padded and washable. In another variant, the second enclosure includes a removable rigid floor member sized to fit within the second enclosure and an elongated front flap for receiving the rigid floor member. The flap is sized to fold over the lowered front wall and attach to the outside of the play yard, thereby preventing the formation of any pocket between the play yard and the parental bed.

In still another variant, the second enclosure further comprises a flexible floor surface.

In a further variant of the invention, the second enclosure includes a mesh floor surface. The surface serves to provide ventilation between the removable floor member and the second enclosure floor surface.

In still another variant, the mesh floor surface further includes reinforcing straps fixedly attached to an underside of the floor surface.

In yet another variant the removable rigid floor member has a top surface and a bottom surface and is covered with a washable fabric and padded on its top surface. In still another variant the removable rigid floor member is segmented into at least two segments that are closely aligned, is capable of being folded, and is covered with a washable fabric and padded on its top surface. The rigid floor member serves as an enclosure for the playpen when folded for transport and storage.

In yet another variant, the removable rigid floor member further includes at least one pair of reversibly separable attachment means and the second enclosure includes a series of openings sized shaped and located to permit the attachment means to secure the floor member to the means for removably supporting the second enclosure.

In still another variant of the invention, the removable rigid floor member further includes at least one pair of reversibly separable attachment means and the first and second side walls of the playpen further include a series of openings sized shaped and located to permit the attachment means to secure the floor member to the first and second side walls.

In a further variant, height of the back wall, front wall, first and second side walls of the second enclosure may be extended from a first position to at least one second greater position, thereby permitting the bottom of the enclosure to be maintained at at least two different heights relative to a parental bed.

In still a further variant of the invention, the back wall, front wall, first and second side walls of the second enclosure are formed of a flexible material and include at least one attachment means located on the back wall, first and second side walls. The attachment means permit material of the back wall, first and second side walls to be folded and constrained by the attachment means when the the walls are located in each of the first position and an intermediate position, thereby eliminating excessive loose material within the second enclosure.

In yet a further variant, the attachment means is a zipper having at least two mating portions. In another variant of the invention, a flexible covering for the zipper portions serves to prevent injury to an infant or small child.

In yet another variant, the second enclosure further includes a first pair of reversibly separable attachment means for attaching a first side edge of the front wall to a front edge of the first side wall and a second pair of reversibly separable attachment means for attaching a second side edge of the front wall to a front edge of the second side wall, thereby, permitting the second enclosure to serve as a bassinet.

In still a further variant of the invention, the reversibly separable attachment means comprise a pair of zippers. In still another variant, a pair of padded covers extends over the zippers to prevent injury to an infant or small child.

In yet another variant, the convertible playpen configured as a co-sleeper further includes first portions of at least two pair of reversibly separable attachment means. The first portions are fixedly secured to an underside of the elongated front flap. At least two second portions of the attachment means are provided. The second portions are fixedly secured to a lower portion of the front wall of the first enclosure. When the upper front horizontal rail is lowered from the first, upper position to one of the second lower positions the first portions of the pair of the reversibly separable attachment means may be secured to the second portions, thereby securing any excessive front flap material and preventing the formation of any pocket between the elongated front flap and the rigid floor member of the second enclosure.

In still a further variant of the invention, the front wall is formed of flexible material and further includes means for reversibly lowering the front wall, securing any excessive flexible material, and preventing an infant or small child from becoming entrapped by openings in the front wall of the first enclosure when the upper front horizontal rail is lowered from the first, upper position to one of the second lower positions.

In yet another variant, the means for reversibly lowering the front wall further includes a first set of reversibly separable fasteners disposed adjacent a top edge of the front wall adjacent an intersection of the first side wall and a first side of the front wall. A second set of reversibly separable fasteners is located adjacent the top edge of the front wall adjacent an intersection of the second side wall and a second side of the front wall. The reversibly separable fasteners are spaced apart by no more than two inches. When the upper front horizontal rail is lowered from the first, upper position to one of the second lower positions, the reversibly separable fasteners may be opened as necessary to permit the front wall to be lowered while securing any excessive flexible material.

In still another variant of the invention, the second enclosure support means is sized to maintain the bottom of the second enclosure at a level at least two inches below the front horizontal rail when disposed in one of the second positions.

In still a further variant, the securing strap assembly further includes a strap member having a first end and a second end and a resistance plate member having at least two slots vertically aligned and centrally located at which the strap member is attached such that the first end and the second end are equidistant from the plate member. Attachment cooperation means are located at the first end and the second end of the strap member for reversible connection to one of the pairs of securing strap attachment means. Adjusting means are provided for adjusting the length of the strap member and tightening the strap member after connecting the attachment cooperation means to one of the pairs of security strap attachment means. The strap member is properly positioned when it is located under a mattress and above a surface on which the mattress rests on the parental bed and is held in place by the resistance plate member positioned vertically at a side of the parental bed opposite placement of the co-sleeper. When the strap member is tightened the co-sleeper is held fast to the parental bed.

In yet another variant, the convertible playpen configured as a co-sleeper further includes reversibly openable panels in the first and second side walls.

In still another variant of the invention, the first and second sections of the upper front corner members and the receiving means fixedly attached to each front vertical rail for receiving the first section of the upper front corner members and reversibly maintaining the upper front horizontal rail in at least one lower second position further includes a T-shaped slot extending from a lower end of the first section of the upper front corner member to an upper end of the first section. An extendable locating member is positioned on the first section adjacent the T-shaped slot.

A mating first T-shaped protrusion extends from a lower end of the receiving means toward an upper end of the receiving means and into the second section of the upper front corner member, terminating below an upper end of the member. At least two locating features are positioned on the second section and the receiving means adjacent the first T-shaped protrusion. The locating features are sized, shaped and positioned to be removably engaged by the extendable locating member so that the first section of the upper front corner member may be secured to the second section and the receiving means in at least two positions.

In yet a further variant, the second enclosure further includes a pair of removably attached protective corner flaps that are sized, shaped, and positioned to cover the receiving means attached to each front vertical rail.

In still a further variant of the invention, a canopy frame is provided. The canopy frame has a curved top, a front, a back and is sized, shaped and positioned to removably attach to the first and second upper side parallel rails of the co-sleeper. A canopy cover is provided. The cover is formed of flexible material and is removably attached to the canopy frame. A mesh panel is provided. The panel is sized, shaped and located to removably cover the front and the back of the canopy frame, thereby providing ventilation and protection from insects.

In yet another variant, in which the rigid frame is formed of hollow tubing, the front and rear upper horizontal rails each have a first portion and a second portion. Each portion has an inboard end and an outboard end. The frame pivoting devices positioned at center points of the rails further include a connecting frame. The frame is pivotally mounted to the inboard ends of each of the first and second portions of the front and rear lower horizontal rails. The connecting frame includes a pair of locking holes. A pair of spring-loaded buttons is mounted within the upper horizontal rails. The buttons are sized, shaped and positioned to engage the locking holes in the connecting frame when the first and second portions of the rails are collinear. Means are provided for pushing both buttons inwardly so as to clear the locking holes in the connecting frame simultaneously, thereby permitting the upper horizontal rails to be pivoted upwardly.

In yet another variant of the invention, the rigid frame is formed of hollow tubing and the front and rear lower horizontal rails each have a first portion and a second portion. Each portion has an inboard end and an outboard end. The frame pivoting devices are positioned at center points of the rails and further include an outer connecting housing. The connecting housing is formed of rigid material and is pivotally mounted to the inboard ends of each of the first and second portions of the front and rear lower horizontal rails.

An inner spring housing is provided. The spring housing is pivotally mounted to the inboard ends of each of the first and second portions of the front and rear lower horizontal rails such that the pivotal mountings are collinear with the mountings of the outer connecting housing. The inner spring housing is located within the outer connecting housing and is sized, shaped and positioned to fit frictionally about the inboard ends of each of the first and second portions of the rails. The inner spring housing is capable of expanding within the outer connecting housing to permit pivoting of the inboard ends when the rigid frame is folded, thereby providing a means of locking the inboard ends in collinear alignment when the rigid frame is unfolded.

In still another variant, the rigid frame is formed of hollow tubing. The front and rear lower horizontal rails each have a first portion and a second portion. Each portion has an inboard end and an outboard end, and the frame pivoting devices positioned at center points of the rails further include a spring housing. The spring housing is pivotally mounted upon a pair of mounting pins at the inboard ends of each of the first and second portions of the front and rear lower horizontal rails. The spring housing includes first and second pairs of accurate alignment slots and first and second pairs of positioning detents.

First and second alignment pins are provided. The alignment pins are mounted parallel to the mounting pins and are spaced outwardly from the inboard ends of the first and second portions of the front and rear lower horizontal rails. The alignment pins are sized, shaped and located to fit slidably within the arcurate alignment slots. Each of the pairs of positioning detents are spaced apart by a distance slightly less than a diameter of one of the front and rear lower horizontal rails.

When the first and second portions of the front and rear lower horizontal rails are collinear, the rails will be within the spring housing. When the rails are pivoted with respect to one another to fold the playpen, the detents will be urged against the rails by the spring resistance of the housing, causing the housing to spread apart, such resistance serving to maintain the collinear alignment of the rails when the playpen is erected.

In still a further variant, means are provided for changing the height of the co-sleeper such that the level of the front upper horizontal rail when arranged in a second position is substantially even with a top of the mattress of the parental bed. In yet another variant, the height adjusting means includes extensions cooperating with each of the four lower corner leg members.

In still another variant of the invention, the first section of the front upper corner member is a male section and the second section is a female section, the second section having an opening sufficiently small so as to prevent entry of fingers of small children or infants.

In a further variant, the receiving means is a female section for association with the male section. The receiving means has an opening sufficiently small so as to prevent the entry of small fingers of children or infants.

In yet another variant of the invention, at least one locking safety clip is provided. The locking clip is formed of resilient material and includes an elongated member. The member has a first end and a second end. The member is sized and shaped to extend past either end of one of the frame pivoting devices positioned at center points of the front and rear lower horizontal rails. First and second rail engaging portions are provided. The first and second portions are fixedly attached at the first and second ends of the elongated member, respectively. The rail engaging portions are sized, shaped, and positioned to fit frictionally and removably over each of the front and rear lower horizontal rails. When the convertible playpen is erected, the safety clip is positioned over one of the frame pivoting devices and the rail engaging portions are positioned on one of the front and rear lower horizontal rails. In this manner the rails will be constrained from pivoting upwardly until the safety clip is removed.

In a still another variant, the safety clip further includes a flexible attaching member. The attaching member has a first end and a second end and is fixedly joined at its first end to the safety clip. The attaching member has means for permanently attaching to one of the front and rear lower horizontal rails adjacent the pivoting device. The means is permanently joined to the attaching member at its second end. In this manner the safety clip will be constrained within close proximity of the pivoting device, thereby preventing its accidental loss.

In yet a further variant of the invention, the first and second sections of the upper front corner members and the receiving means fixedly attached to each front vertical rail for receiving the first section of the upper front corner members and reversibly maintaining the upper front horizontal rail in at least one lower second position further include a T-shaped protrusion extending from a lower end of the first section of the upper front corner member to an upper end of the section. An extendable locating member is positioned on the first section adjacent the T-shaped protrusion. A second mating T-shaped slot extends from a lower end the second section of the upper front corner member and terminates below an upper end of the member.

A first locating feature is positioned on the second section adjacent the second T-shaped slot. The first locating feature is sized, shaped and positioned to be removably engaged by the extendable locating member so that the first section of the upper front corner member may be secured to the second section. A first receiving portion is located on the front vertical rail a first preset distance below the second section of the upper front corner member. The first portion includes a third mating T-shaped slot extending from a lower end of the first portion that terminates below an upper end of the first portion.

A second locating feature is located on the first portion adjacent the third T-shaped slot. The second locating feature is sized, shaped and positioned to be removably engaged by the extendable locating member so that the first section of the upper front corner member may be secured to the first portion. A second receiving portion is located on the front vertical rail a second preset distance below the second section of the upper front corner member. The second portion includes a fourth mating T-shaped slot extending from a lower end of the second portion that terminates below an upper end of the second portion.

A third locating feature is positioned on the second portion adjacent the fourth T-shaped slot. The third locating feature is sized, shaped and positioned to be removably engaged by the extendable locating member so that the first section of the upper front corner member may be secured to the second portion.

In still another variant of the invention, the first and second sections of the upper front corner members and the receiving means fixedly attached to each front vertical rail for receiving the first section of the upper front corner members and reversibly maintaining the upper front horizontal rail in at least one lower second position further include a shortened T-shaped protrusion located between a lower end of the first section of the upper front corner member and an upper end of the section.

An extendable locating member located on the first section below the T-shaped protrusion is provided. A second mating T-shaped slot extends from a lower end of the second section of the upper front corner member and terminates below an upper end of the member. The slot includes an opening located between the upper end and the lower end of the member. The opening is sized and shaped to permit entry of the T-shaped protrusion.

A first locating feature is located on the second section adjacent the second T-shaped slot. The first locating feature is sized, shaped and located to be removably engaged by the extendable locating member so that the first section of the upper front corner member may be secured to the second section.

A first receiving portion is provided. The first portion is located on the front vertical rail a first preset distance below the second section of the upper front corner member. The first portion includes a third mating T-shaped slot. The third slot extends from a lower end of the first portion and terminates below an upper end of the first portion. The T-shaped slot includes an opening located between the upper end and the lower end of the portion. The opening is sized and shaped to permit entry of the T-shaped protrusion.

A second locating feature is located on the first portion adjacent the third T-shaped slot. The second locating feature is sized, shaped and located to be removably engaged by the extendable locating member so that the first section of the upper front corner member may be secured to the first portion.

A second receiving portion is provided. The second portion is located on the front vertical rail a second preset distance below the second section of the upper front corner member. The second portion includes a fourth mating T-shaped slot. The fourth slot extends from a lower end of the second portion and terminates below an upper end of the second portion. The T-shaped slot includes an opening located between the upper end and the lower end of the portion, and is sized and shaped to permit entry of the T-shaped protrusion.

A third locating feature located on the second portion adjacent the fourth T-shaped slot is provided. The third locating feature is sized, shaped and located to be removably engaged by the extendable locating member so that the first section of the upper front corner member may be secured to the second portion.

In a final variant, the second enclosure further includes a pair of removably attached protective corner flaps. The flaps are sized, shaped, and located to cover the first and second receiving portions attached to each front vertical rail.

DETAILED DESCRIPTION OF THE PREFERRED EMBODIMENTS

Figure 1:
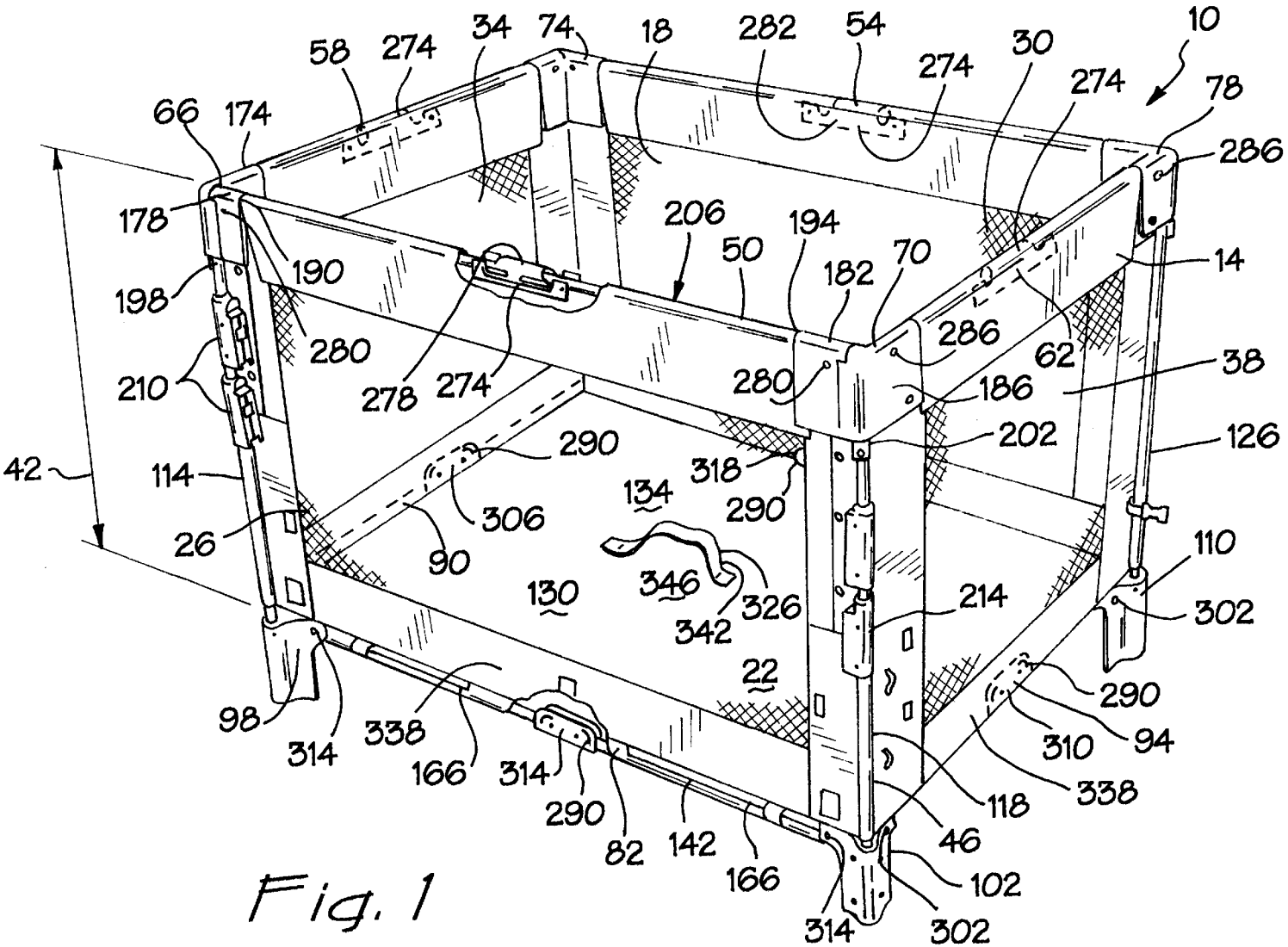
FIG. 1 is a perspective view of the first enclosure of the preferred embodiment of the invention.

As illustrated in FIG. 1, the present invention is a playpen 10 convertibly adapted for use as a bassinet, changing table and co-sleeper. The playpen 10 includes a rigid first enclosure 14 with an open top 18, a floor 22, a front wall 26, a back wall 30, a first side wall 34 and a second side wall 38. The enclosure 14 is of a first predetermined height 42 and has a rigid frame 46.

The frame 46 is formed at the top 18 by front 50 and rear 54 upper parallel horizontal rails, first 58 and second 62 upper side horizontal rails, two upper front corner members 66, 70 and two upper rear corner members 74, 78 in cooperation with them. The frame 46 is formed adjacent the floor 22 by front 82 and rear (not shown) lower parallel horizontal rails, first side 90 and second side 94 lower parallel horizontal rails and four lower corner leg members 98, 102, (not shown), 110 in cooperation with them. A pair of front vertical rails 114, 118 and a pair of rear vertical rails (not shown), 126 are in further cooperation with the two upper front corner members 66, 70, the two upper rear corner members 74, 78 and the four lower corner leg members 98, 102, 106, 110. The rigid frame 46 supports the floor 22, the front wall 26, the back wall 30, the first side wall 34 and the second side wall 38.

Figure 6:
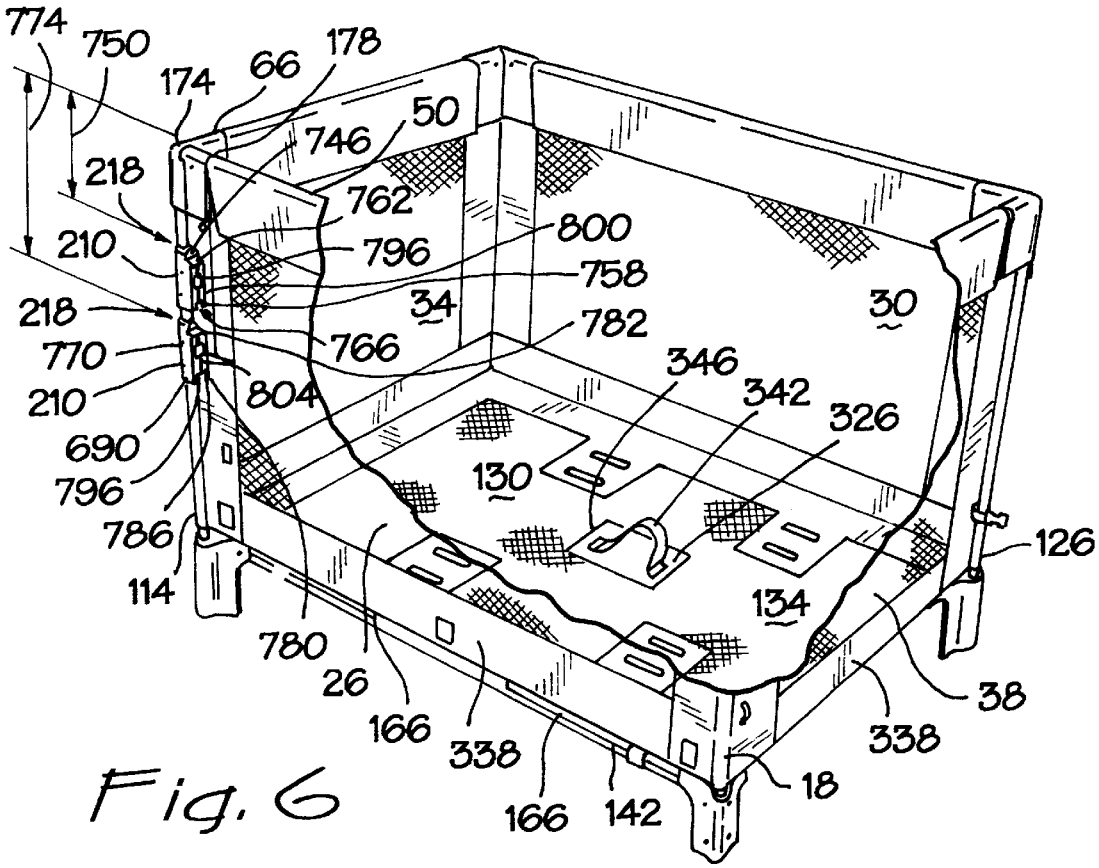
FIG. 6 is a partial cutaway perspective of the FIG. 1 embodiment illustrating the mesh floor and dual receiving means for the first section of the upper front corner unit.
Figure 8:
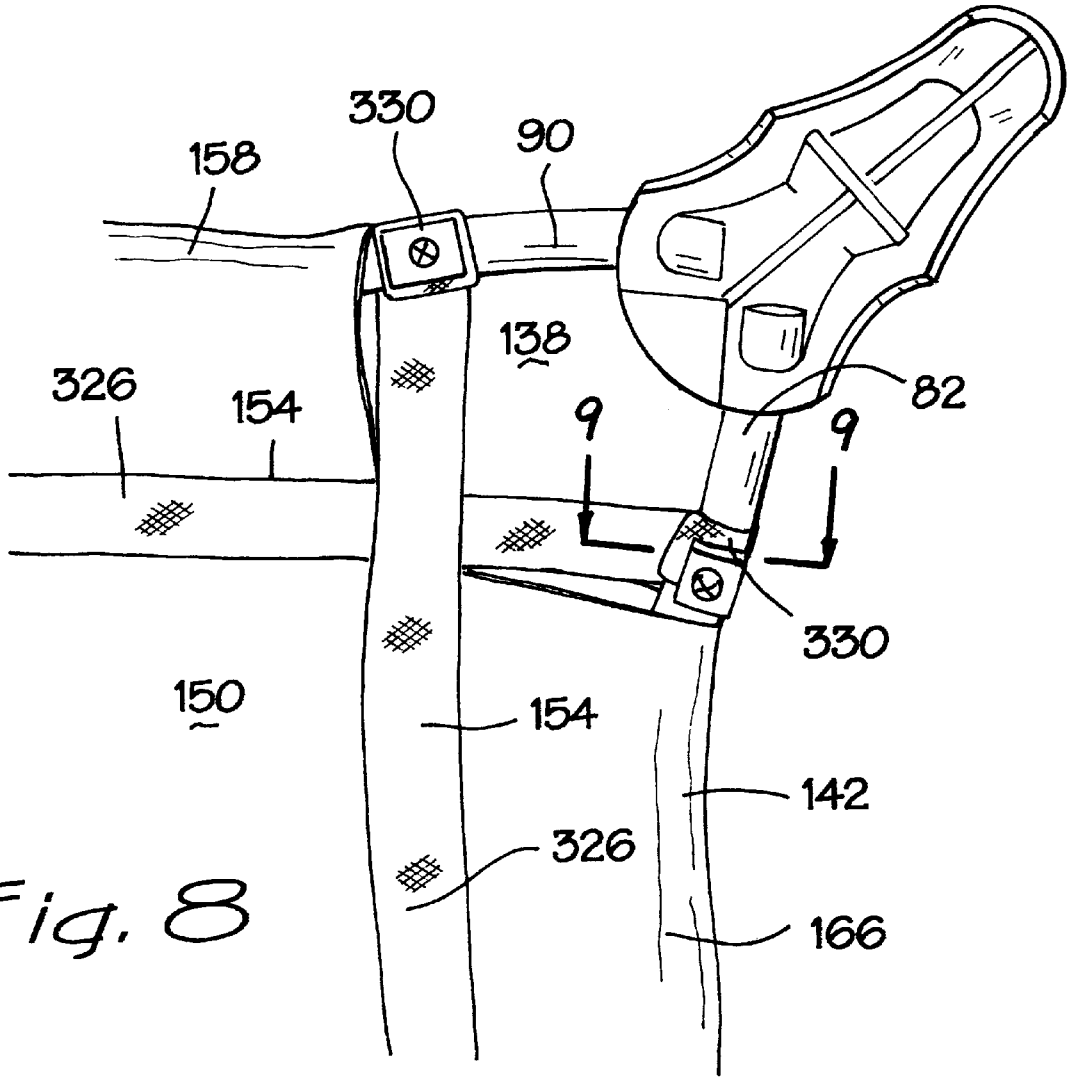
FIG. 8 is a plan view detail of the underside of the floor panel and the floor reinforcing panel.

As illustrated in FIGS. 1, 6 and 8, the floor 22 further includes a floor panel 130 attached to the front 26, back 30, first side 34 and second side 38 walls. The floor panel 130 has a top surface 134 and a bottom surface 138. A floor-reinforcing panel 142 is provided. The reinforcing panel 142 has substantially the same planar dimensions as the floor panel 130 and has an upper surface (not shown), a lower surface 150, a perimeter 154 and at least four fastening portions 158, 166, extending outwardly from the perimeter 154. The reinforcing panel 142 is fixedly attached at its upper surface to the bottom surface of the floor panel 130. The fastening portions 158, 166 are fixedly attached to each of the front 82 and rear lower parallel horizontal rails and to the first 90 and second 94 side lower parallel horizontal rails.

Figure 3:
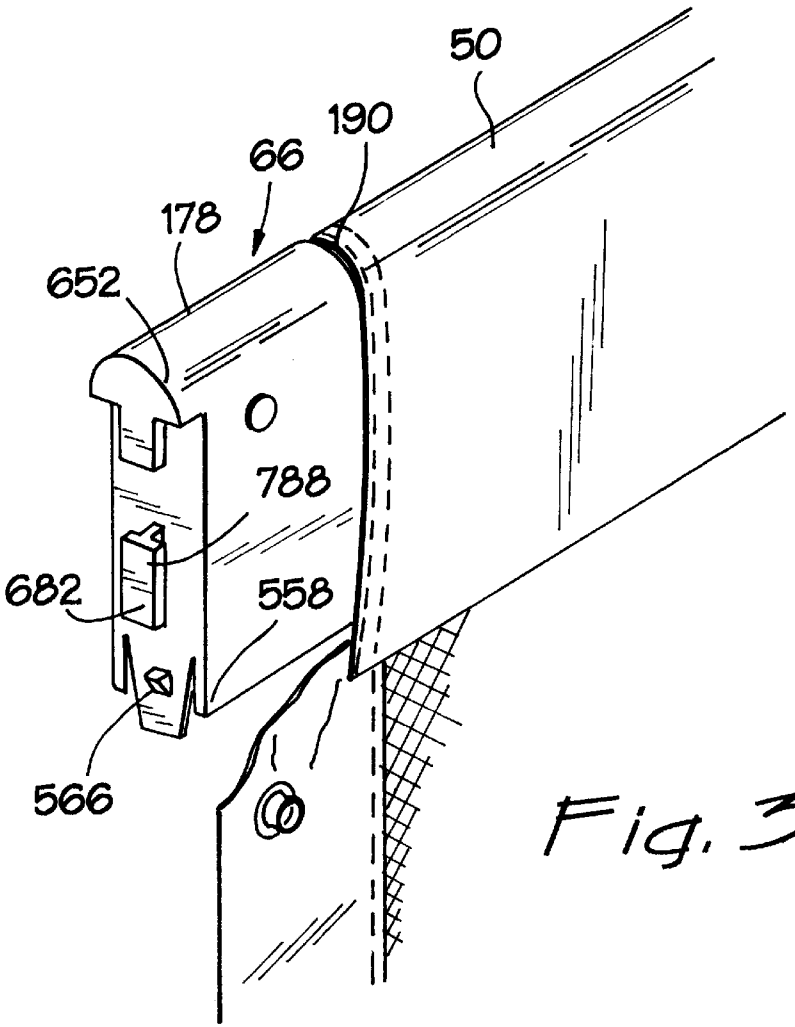
FIG. 3 is a perspective view of a first embodiment of the first section of the reversibly separable upper front corner unit.
Figure 2:
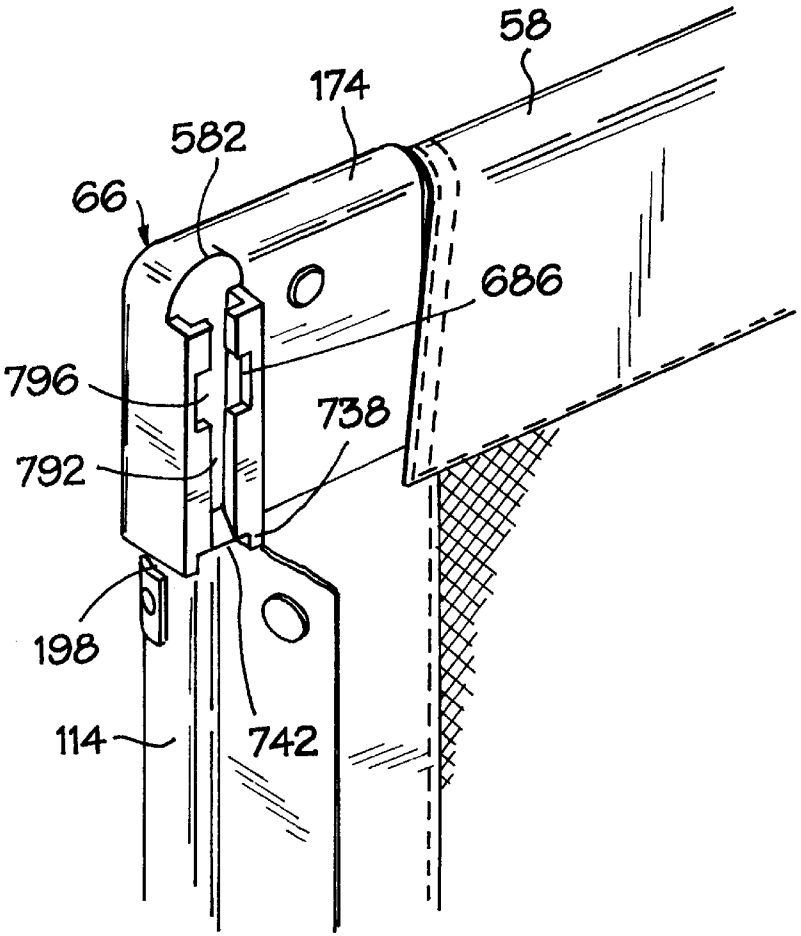
FIG. 2 is a perspective view of a first embodiment of the second section of the reversibly separable upper front corner unit.

As illustrated in FIGS. 1–3, each upper front corner member 66, 70 is constructed of two reversibly separable complementary sections 174, 178, 182, 186. The first of these sections 178, 182 is fixedly attached to an end 190, 194 of the front upper horizontal rail 50 and the second of these sections 174, 186 is fixedly attached to the upper end 198, 202 of one of the front vertical rails 114, 118. The upper front corner members 66, 70 support the upper front horizontal rail 50 in its first position 206.

Figure 10:
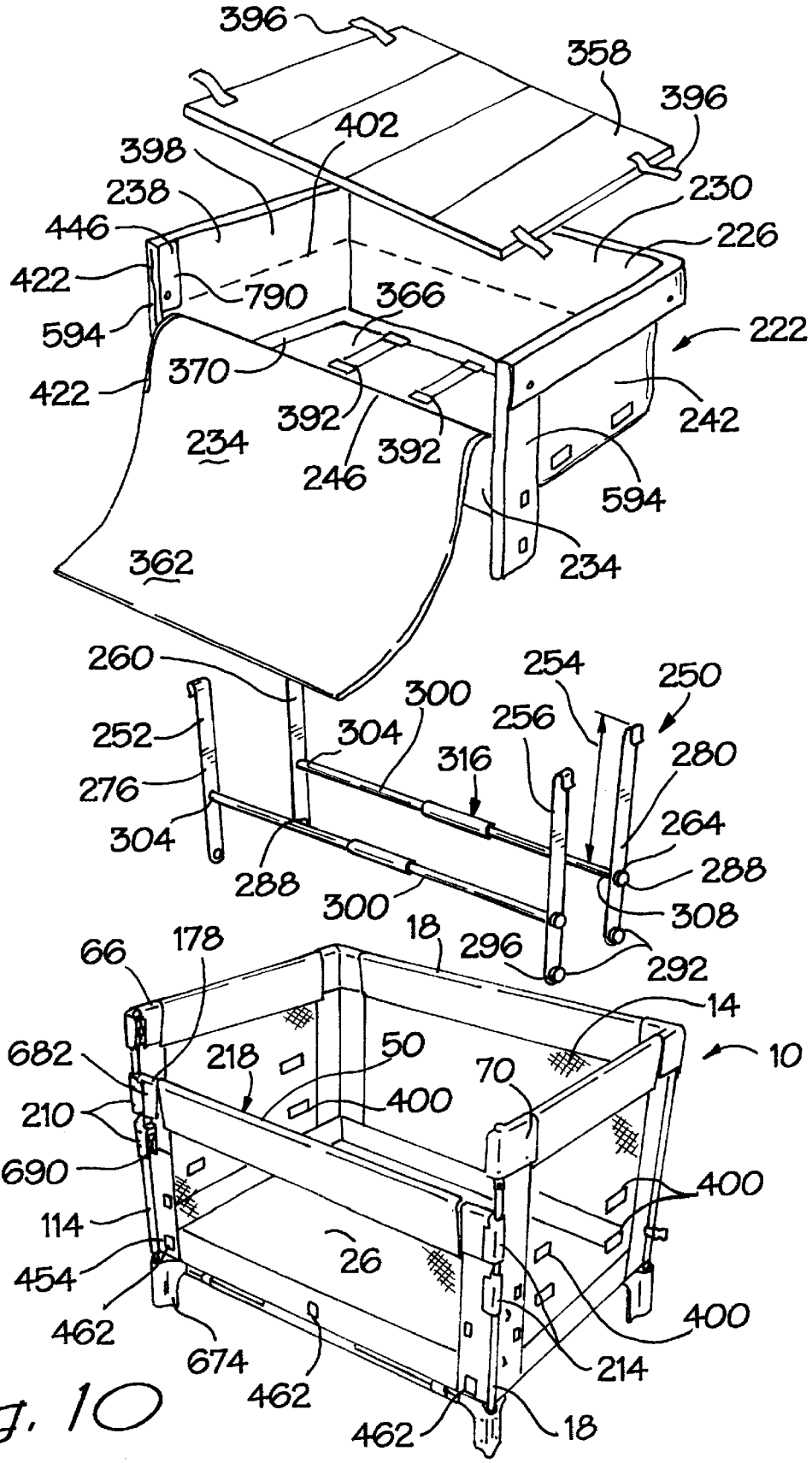
FIG. 10 is an exploded, perspective view of the FIG. 1 embodiment illustrating the second enclosure, means for supporting the second enclosure, rigid floor member and lowered front upper horizontal rail.

As illustrated in FIG. 10, receiving means 210, 214 are fixedly attached to each front vertical rail 114, 118 for receiving the first section 178, 182 of an upper front corner member 66, 70 and reversibly maintaining the upper front horizontal rail 50 in at least one lower, second position 218, thereby maintaining structural rigidity of the playpen 10 when the upper front horizontal rail 50 is in one of the second positions 218.

A second enclosure 222 is provided. The second enclosure 222 is sized to fit substantially within the first enclosure 14 and has an open top 226, a back wall 230, a front wall 234, first 238 and second 242 side walls and a bottom 246. Means 250 are provided for removably supporting the second enclosure 222 within the first enclosure 14 at at least one predetermined distance 254 from the top 18 of the first enclosure 14.

Figure 18:
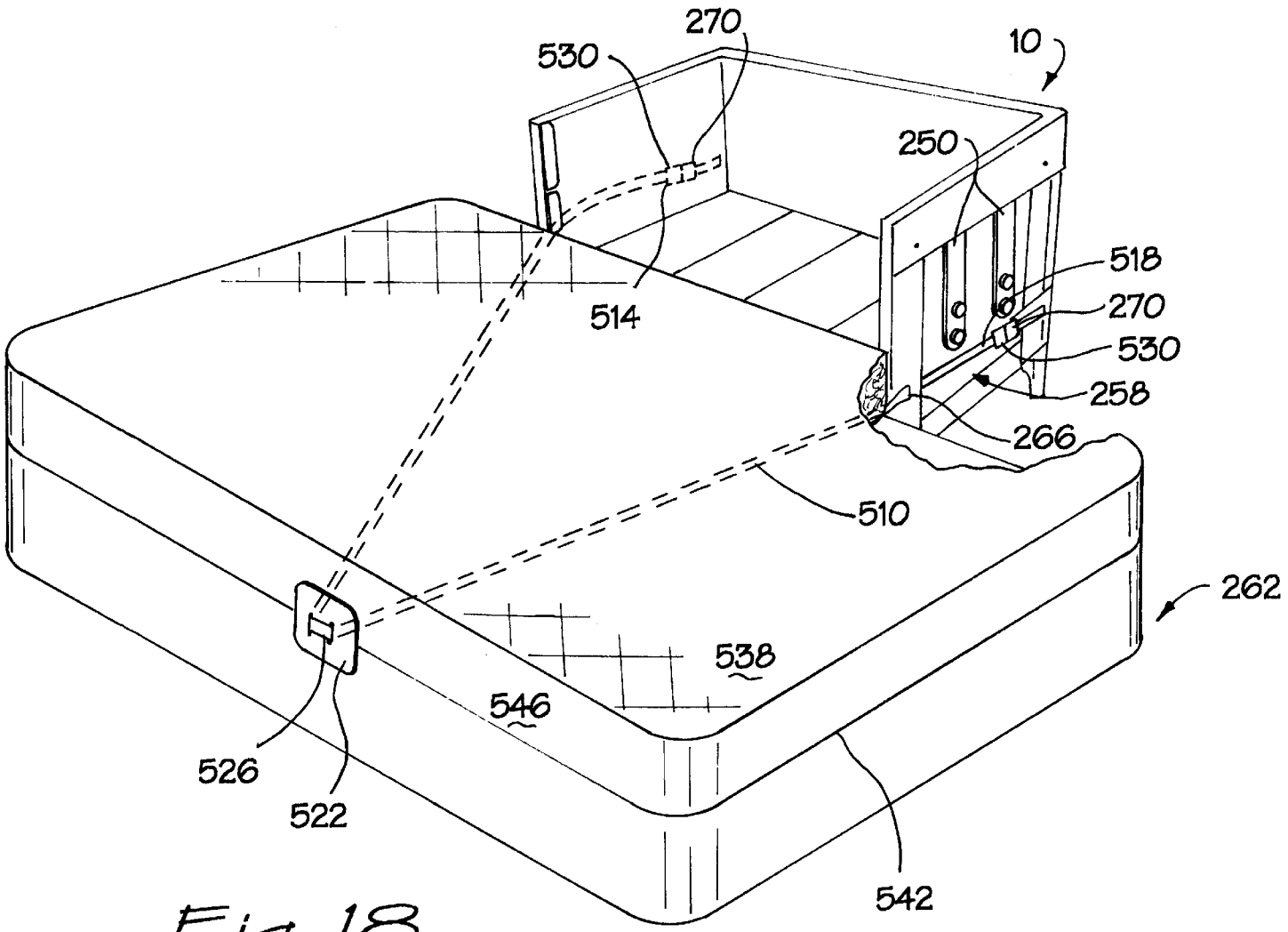
FIG. 18 is perspective view of the co-sleeper attached to the parents' bed by means of the safety strap assembly.

As illustrated in FIG. 18, a securing strap assembly 258 for securing to a parental bed 262 is provided, along with at least one pair of alignment means 266 through which the securing strap assembly 258 is directed. These alignment means 266 maintain the securing strap assembly 258 in horizontal orientation and preventing lifting or bucking of the playpen 10 when used as a co-sleeper. At least one pair of attachment means 270 for fastening the securing strap assembly 258 to the playpen 10 is provided.

The playpen 10 is ready for use as a co-sleeper when the upper front horizontal rail 50 is in one of the second positions 218, the second enclosure 222 is supported by the second enclosure support means 250, the securing strap assembly 258 is directed through one of the alignment means 266, fastened to one of the attachment means 270 and is properly positioned and secured to the parental bed 262.

As illustrated in FIG. 10, in a variant of the invention, the means 250 for removably supporting the second enclosure 222 within the first enclosure 14 at at least one predetermined distance 254 from the top 18 of the first enclosure 14 further includes first 252, second 256, third 260 and fourth 264 support hangers. Each of the support hangers 252, 256, 260, 264 has a first end 268, a second end 272, an inner side 276 and an outer side 280. Each of the support hangers 252, 256, 260, 264 has a curved hooking portion 284 located at the first end 268.

Figures 11, 12, 13:
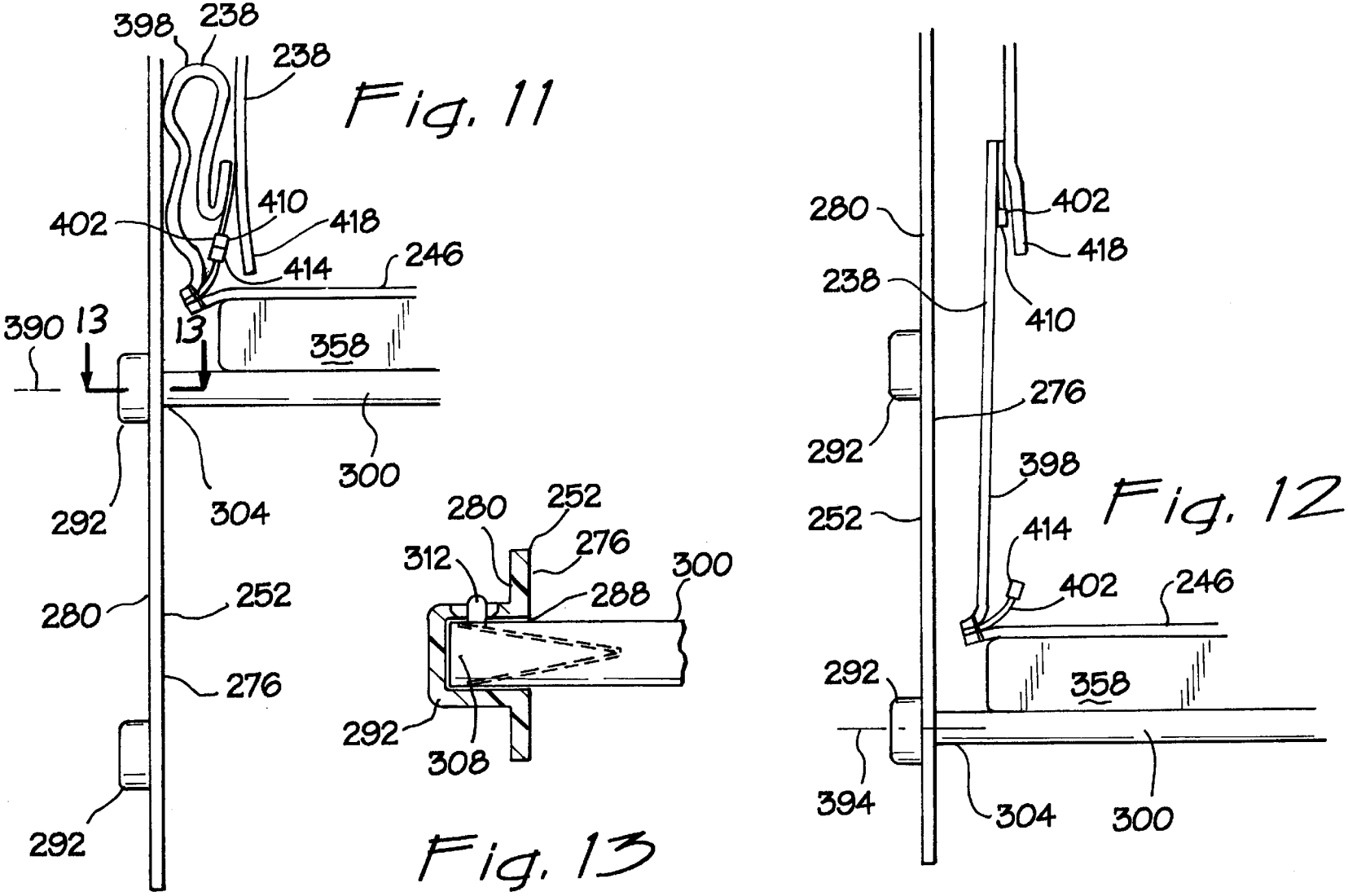
FIG. 11 is a cross-sectional front view of the second enclosure fastened in the first position.
FIG. 12 is a cross-sectional front view of the second enclosure in a second, extended position.
FIG. 13 is a cross-sectional side view of the spring button housing and support rod.

The hooking portion 284 is sized and shaped to fit frictionally over the first enclosure 14 and one of the first 58 and second 62 upper side horizontal rails. Each of the support hangers 252, 256, 260, 264 further includes at least two circular orifices 288. The orifices 288 extend from the inner side 276 to the outer side 280 of the hangers 252, 256, 260, 264. As illustrated in FIGS. 10 and 13, the hangers 252, 256, 260, 264 also include at least two spring button housings 292. The housings 292 are located on the outer sides 280 of the support hangers 252, 256, 260, 264 adjacent to the orifices 288. Each of the spring button housings 292 includes a finger opening 296.

Two support rods 300 are provided. Each of the rods 300 has a first end 304 and a second end 308. The rods 300 are sized and shaped to extend between one of the first 252 and second 256 support hangers and one of the third 260 and fourth 264 support hangers when the support hangers 252, 256, 260, 264 are located on the first enclosure 14 and one of to the first 58 and second 62 upper side horizontal rails. Each of the support rods 300 has a spring button 312 mounted at the first end 304 and the second end 308. The spring button 312 is sized and shaped to engage the spring button housing 292.

When the first 304 and second 308 ends of the support rods 300 are introduced into the orifices 288 of the support hangers252, 256, 260, 264, and the support hangers 252, 256, 260, 264 are located on the first enclosure 14 and one of the first 58 and second 62 upper side horizontal rails, the spring buttons 312 will removably engage the spring button housings 292 of the hangers 252, 256, 260, 264, thereby providing a support platform 316 for the second enclosure 222.

Figure 4:
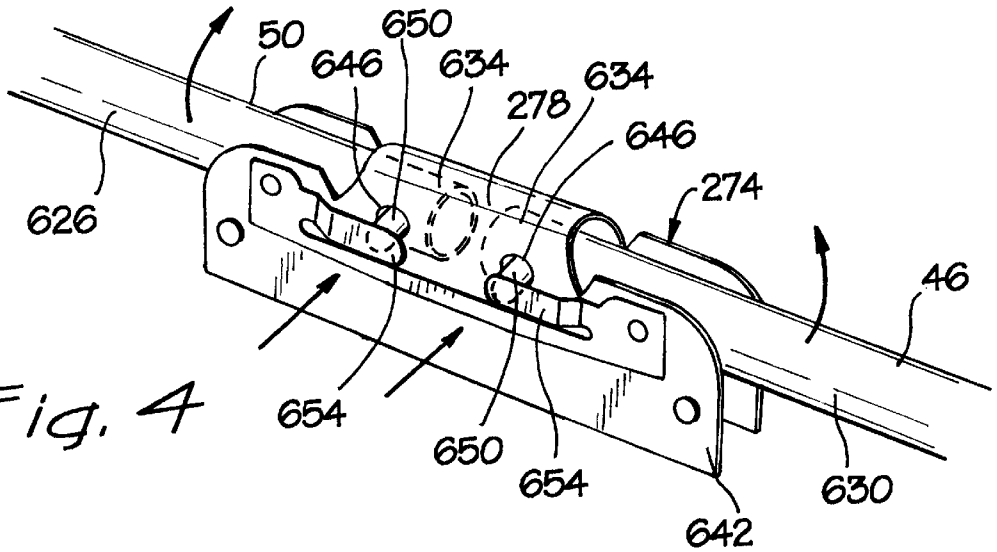
FIG. 4 is a perspective view of a first embodiment of a frame locking device.

In a variant of the invention, as illustrated in FIG. 1, the rigid frame 46 further includes means 280 for pivotally mounting the front 50 and rear 54 upper horizontal rails to the upper front corner members 66, 70 and upper rear corner members 74, 78, respectively. As illustrated in FIGS. 1 and 4, frame locking devices 274 are pivotally mounted at center points 278, 282 of the front 50 and rear 54 upper horizontal rails. These devices 274 permit the upper rails 50, 54 to pivot downwardly from the open top 18 of the first enclosure 14.

Means 286 are provided for pivotally mounting the first 58 and second 62 upper side horizontal rails to the upper front 66, 70 and rear 74, 78 corner members. Frame locking devices 274 are pivotally mounted at center points 294, 298 of the first 58 and second 62 upper side horizontal rails. These devices 274 permit each of the rails 58, 62 to pivot downwardly from the open top 18 of the first enclosure 14. Means 302 arc provided for pivotally mounting the first side 90 and second side 94 lower horizontal rails to the lower front 98, 102 and rear 106, 110 corner members.

Figure 5:
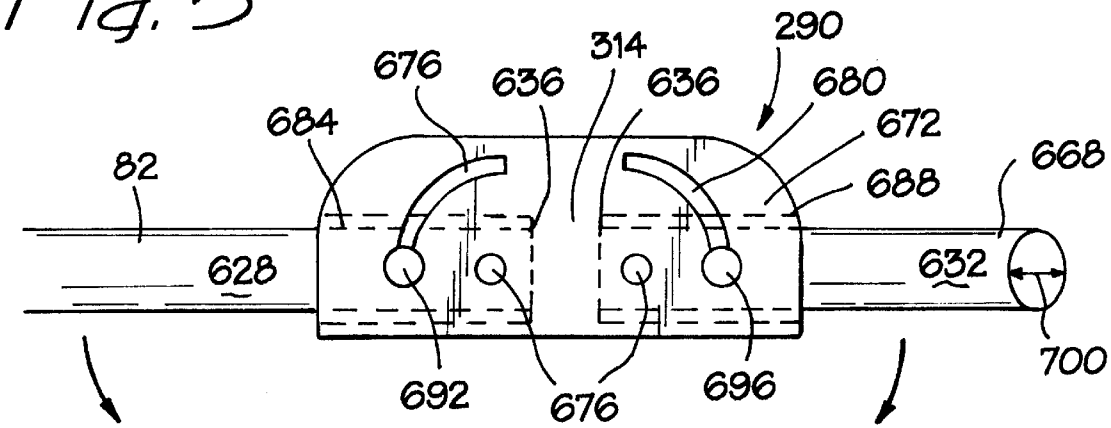
FIG. 5 is a perspective view of a frame pivoting device.

As illustrated in FIGS. 1 and 5, frame pivoting devices 290 are pivotally mounted at center points 306, 310 of the first 90 and second side 94 lower horizontal rails, permitting each of the rails 90, 94 to pivot upwardly from the floor 22 of the first enclosure 14. Means 314 are provided for pivotally mounting the front 82 and rear 86 lower horizontal rails to the lower front 98, 102 and rear 106, 110 corner members, respectively. Frame pivoting devices 290 are pivotally mounted at center points 314, 318 of the front 82 and rear 86 lower horizontal rails. These devices 290 permit each of the rails 82, 86 to pivot upwardly from the floor 22 of the first enclosure 14.

Figure 29:
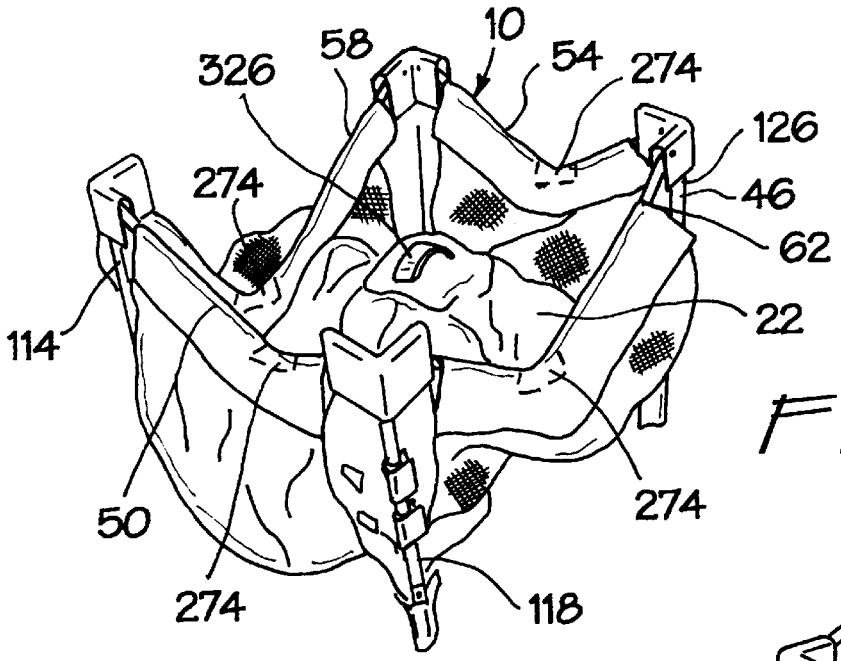
FIG. 29 is a perspective view of the FIG. 1 embodiment in partially collapsed condition.
Figure 30:
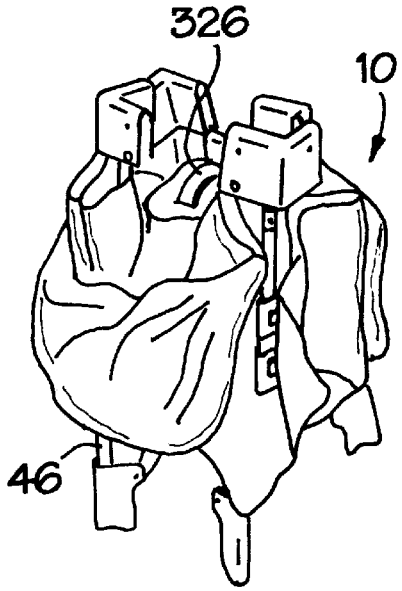
FIG. 30 is a perspective view of the FIG. 1 embodiment in further collapsed condition.
Figure 31:
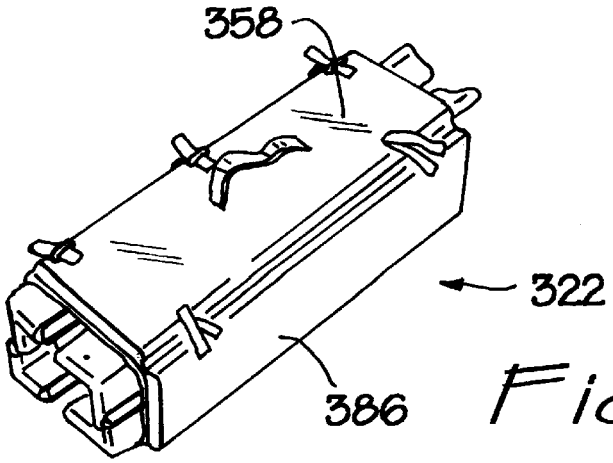
FIG. 31 is a perspective view of the FIG. 1 embodiment secured within the segmented rigid floor member as a compact package for transportation and storage.

As illustrated in FIGS. 29–31, the frame 46 may be quickly folded into a compact package 322 for transport and storage by releasing the locking devices 274 positioned on the front 50 and rear 54 upper horizontal rails and depressing the upper horizontal rails 50, 54 downwardly while pulling upwardly on a handle 326 (FIGS. 29 and 30) attached to the floor 22. This causes the upper 58, 62 and lower 90, 94 side horizontal rails and front 82 and rear 86 lower horizontal rails to bend upwardly and the vertical rails 114, 118, 126, to move inwardly.

Figure 9:
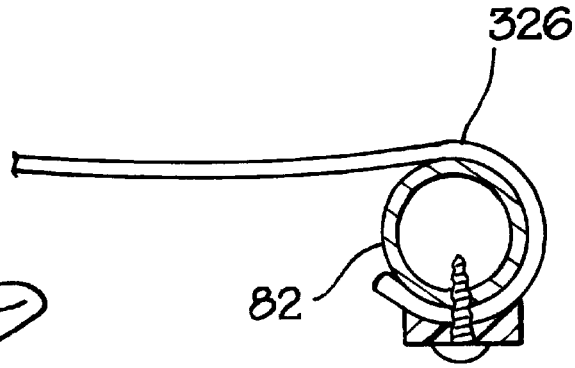
FIG. 9 is a cross-sectional detail of FIG. 8 taken along the line 9—9.

In a further variant of the invention, as illustrated in FIGS. 8 and 9, the floor 22 further includes at least four reinforcing straps 326. The straps 326 have first 330 and second (not shown) ends and are fixedly attached to the lower surface 150 of the reinforcing panel 142. Two of the straps 326 are secured at their first 330 and second ends to each of the front 82 and rear lower horizontal rails, respectively and two of the straps 326 are secured at their first 330 and second ends to each of the first 90 and second 94 side lower horizontal rails, respectively. As illustrated in FIGS. 1 and 6, four padded covers 338 are provided. The covers 338 are fixedly attached to the floor panel 130 and at least one of the fastening portions 158, 166 to protect the frame pivoting devices 290 attached to the front 82 and rear 86 lower horizontal rails and those attached to the first 90 and second 94 side lower horizontal rails.

A flexible loop 342 is provided. The loop 342 is fixedly attached to a central portion 346 of the top surface 134 of the floor panel 130 and provides a handle for lifting the floor 22. A hollow leg member (not shown) is affixed to a central portion 354 of the lower surface 138 of the reinforcing panel 142 to provide support for it.

In yet a further variant of the invention, as illustrated in FIG. 10, the second enclosure 222 is padded and washable. In another variant, the second enclosure 222 includes a removable rigid floor member 358 sized to fit within the second enclosure 222 and an elongated front flap 362 for receiving the rigid floor member 358. The flap 362 is sized to fold over the lowered front wall 26 and attach to the outside of the playpen 10, thereby preventing the formation of any pocket between the playpen 10 and the parental bed 262.

In still another variant, the second enclosure 222 further comprises a flexible floor surface 366. In a further variant of the invention, the second enclosure 222 includes a mesh floor surface 370. The surface 370 serves to provide ventilation between the removable floor member 358 and the second enclosure floor surface 370.

In still another variant, the mesh floor surface 370 further includes reinforcing straps (not shown) fixedly attached to an underside (not shown) of the floor surface 370.

Figure 7:
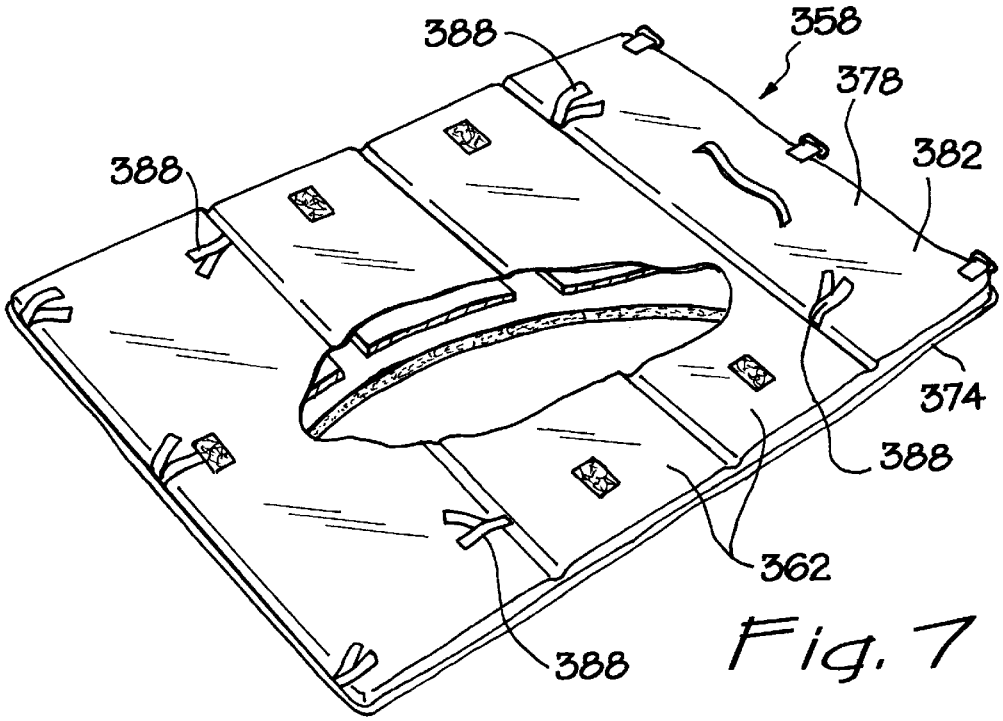
FIG. 7 is a perspective view of a segmented version of the rigid floor member.

In yet another variant, as illustrated in FIG. 7, the removable rigid floor member 358 has a top surface 374 and a bottom surface 378 and is covered with a washable fabric 382 and padded on its top surface 374. In still another variant the removable rigid floor member 358 is segmented into at least two segments 362 that are closely aligned, is capable of being folded, and is covered with a washable fabric 382 and padded on its top surface 374. As illustrated in FIG. 31, the rigid floor member 358 serves as an enclosure 386 for the playpen 10 when folded for transport and storage.

In yet another variant, as illustrated in FIGS. 7 and 10, the removable rigid floor member 358 further includes at least one pair of reversibly separable attachment means 388 and the second enclosure 222 includes a series of openings 392 sized shaped and located to permit the attachment means 388 to secure the floor member 358 to the means 250 for removably supporting the second enclosure 222.

In still another variant of the invention, as illustrated in FIG. 10, the removable rigid floor member 358 further includes at least one pair of reversibly separable attachment means 396 and the first 34 and second 38 side walls of the playpen 10 further include a series of openings 400 sized shaped and located to permit the attachment means 396 to secure the floor member 358 to the first 34 and second 38 side walls.

In a further variant, as illustrated in FIGS. 10-12, height of the back wall 230, front wall 234, first 238 and second 242 side walls of the second enclosure 222 may be extended from a first position 390 to at least one second greater position 394, thereby permitting the bottom 246 of the enclosure 222 to be maintained at at least two different heights relative to a parental bed 262.

In still a further variant of the invention, the back wall 230, front wall 234, first 238 and second 242 side walls of the second enclosure 222 are formed of a flexible material 398 and include at least one attachment means 402 located on the back wall 230, first 234 and second 238 side walls. The attachment means 402 permit material 398 of the back wall 230, first 238 and second 242 side walls to be folded and constrained by the attachment means 402 when the walls 230, 238, 242 are located in each of the first position 390 and an intermediate position (not shown), thereby eliminating excessive material 398 within the second enclosure 222.

Figure 14:
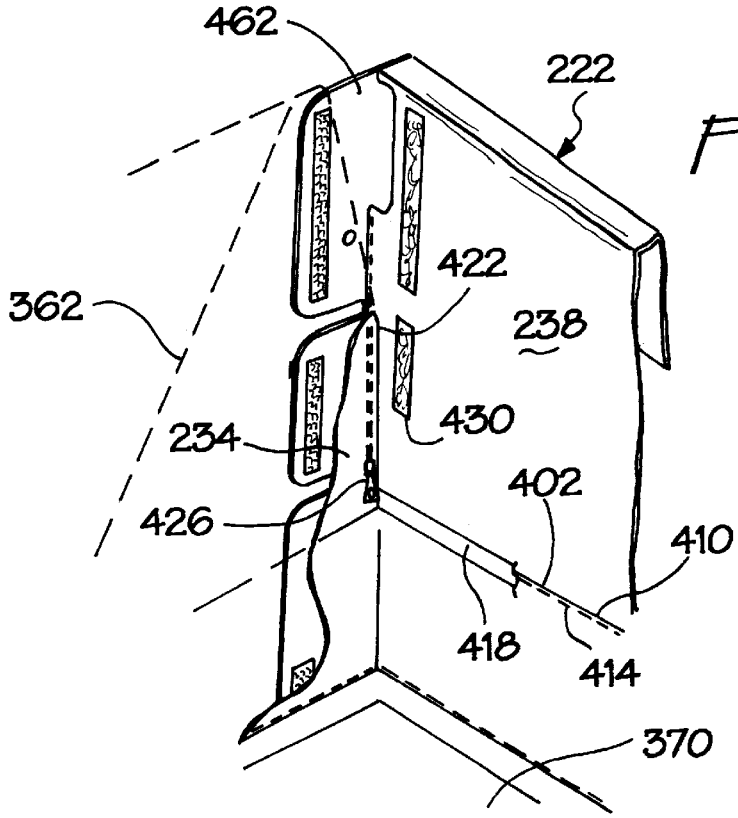
FIG. 14 is a perspective view of the interior of the second enclosure illustrating zippers used in adjusting the height of the enclosure and reversibly separable fasteners for protective covers for the zippers.
Figure 15:
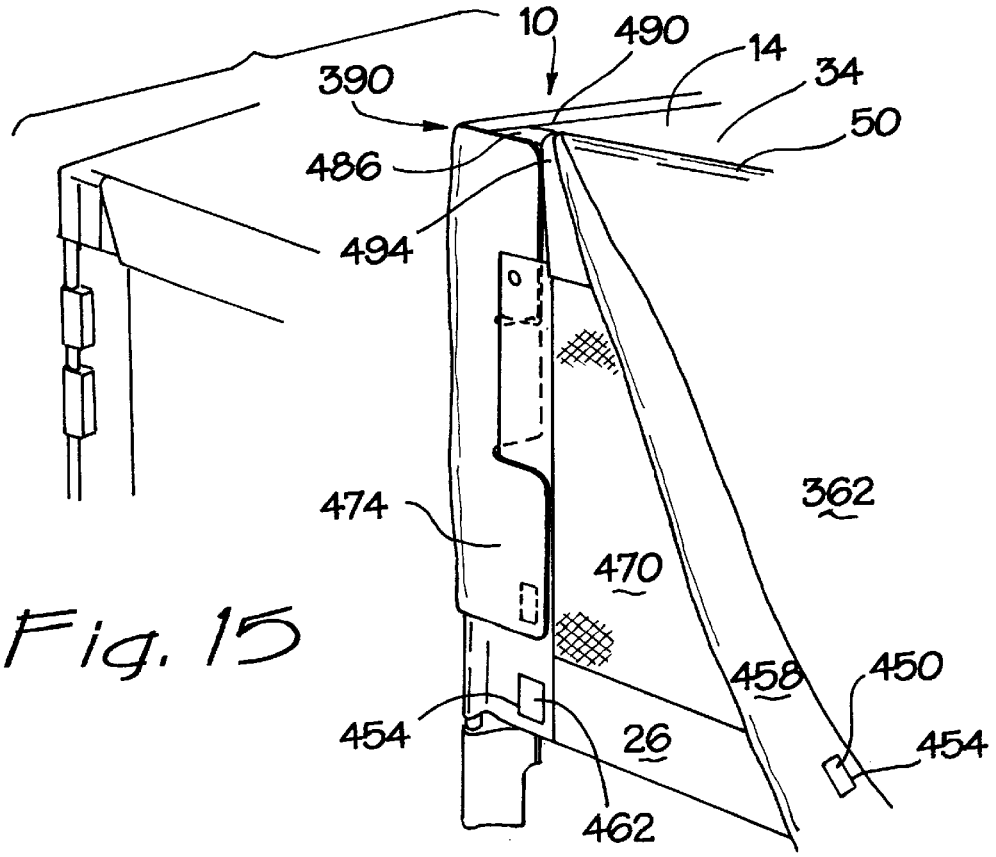
FIG. 15 is a perspective view of the reversibly separable fasteners for use in conjunction with lowering the front wall illustrated in closed position and illustrating the means for attaching the extended front flap of the second enclosure to the front wall of the co-sleeper.
Figure 16:
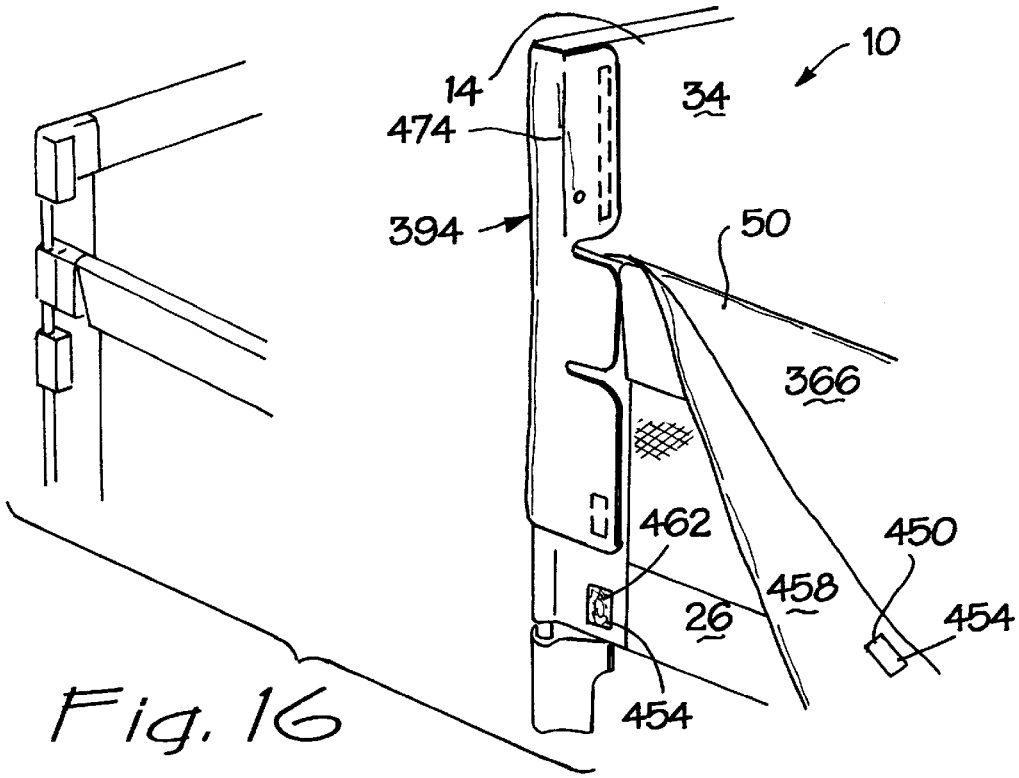
FIG. 16 is a perspective view of the reversibly separable fasteners for use in conjunction with lowering the front wall illustrated in closed position with the front wall in a lowered second position.
Figure 17:
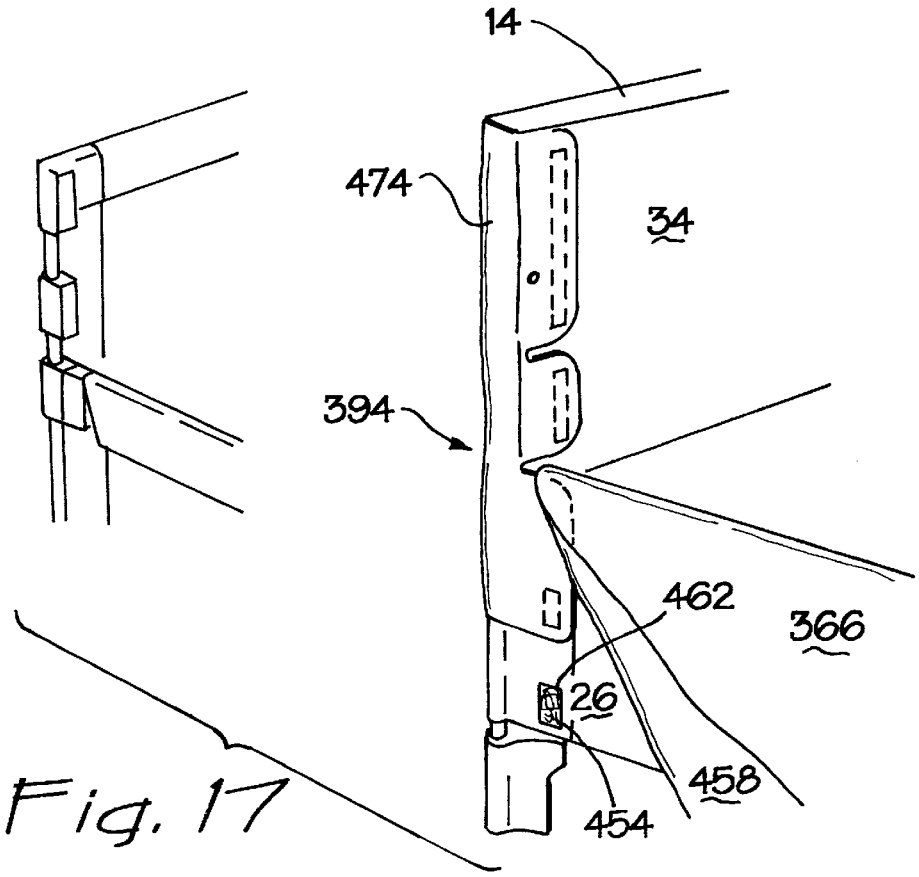
FIG. 17 is a perspective view of the reversibly separable fasteners for use in conjunction with lowering the front wall illustrated in closed position with the front wall in a further lowered second position.

In yet a further variant, as illustrated in FIG. 14, the attachment means 402 is a zipper having at least two mating portions 410, 414. In another variant of the invention, a flexible covering 418 for the zipper portions 410, 414 serves to prevent injury to an infant or small child.

In yet another variant, as illustrated in FIGS. 10 and 14, the second enclosure 222 further includes a first pair of reversibly separable attachment means 422 for attaching a first side edge 426 of the front wall 234 to a front edge 430 of the first side wall 238 and a second pair of reversibly separable attachment means 434 for attaching a second side edge 438 of the front wall 234 to a front edge 442 of the second side wall 242, thereby, permitting the second enclosure 222 to serve as a bassinet.

In still a further variant of the invention, the reversibly separable attachment means 422, 434 comprise a pair of zippers. In still another variant, a pair of padded covers 446 extend over the zippers 422, 434 to prevent injury to an infant or small child.

In yet another variant, as illustrated in FIGS. 10 and 15–17, the convertible playpen 10 configured as a co-sleeper further includes first portions 450 of at least two pair of reversibly separable attachment means 454. The first portions 450 are fixedly secured to an underside 458 of the elongated front flap 362. At least two second portions 462 of the attachment means 454 are provided. The second portions 462 are fixedly secured to a lower portion 466 of the front wall 26 of the first enclosure 14. When the upper front horizontal rail 50 is lowered from the first 390, upper position to one of the second lower positions 394 the first portions 450 of the pair of the reversibly separable attachment means 454 may be secured to the second portions 462, thereby securing any excessive front flap 362 material and the formation of any pocket between the elongated front flap and the rigid floor member of the second enclosure.

In still a further variant of the invention, as illustrated in FIGS. 14–17, the front wall 26 is formed of flexible material 470 and further includes means 474 for reversibly lowering the front wall 26, securing any excessive flexible material 470, and preventing an infant or small child from becoming entrapped by openings 478 in the front wall 26 of the first enclosure 14 when the upper front horizontal rail 50 is lowered from the first 390, upper position to one of the second lower positions 394.

In yet another variant, the means 474 for reversibly lowering the front wall 26 further includes a first set of reversibly separable fasteners 482 disposed adjacent a top edge 486 of the front wall 26 adjacent an intersection 490 of the first side wall 34 and a first side 494 of the front wall 26. A second set of reversibly separable fasteners (not shown) is located adjacent the top edge 486 of the front wall 26 adjacent an intersection (not shown) of the second side wall 38 and a second side (not shown) of the front wall 26. The reversibly separable fasteners 482 are spaced apart by no more than two inches. When the upper front horizontal rail 50 is lowered from the first 390, upper position to one of the second 394 lower positions, the reversibly separable fasteners 482 may be opened as necessary to permit the front wall 26 to be lowered while securing any excessive flexible material 470.

In still another variant of the invention, as illustrated in FIGS. 10 and 12, the second enclosure support means 250 is sized to maintain the bottom 246 of the second enclosure 222 at a level at least two inches below the front horizontal rail 50 when disposed in one of the second 394 positions.

In still a further variant, as illustrated in FIG. 18, the securing strap assembly 258 further includes a strap member 510 having a first end 514 and a second end 518 and a resistance plate member 522 having at least two slots 526 vertically aligned and centrally located at which the strap members 510 is attached such that the first end 514 and the second end 518 are equidistant from the plate member 522. Attachment cooperation means 530 are located at the first end 514 and the second end 518 of the strap member 510 for reversible connection to one of the pairs of securing strap attachment means 270. Adjusting means 534 are provided for adjusting the length of the strap member 510 and tightening the strap member 510 after connecting the attachment cooperation means 530 to one of the pairs of security strap attachment means 270. The strap member 510 is properly positioned when it is located under a mattress 538 and above a surface 542 on which the mattress 538 rests on the parental bed 262 and is held in place by the resistance plate member 522 positioned vertically at a side 546 of the parental bed 262 opposite placement of the co-sleeper 10. When the strap member 510 is tightened the co-sleeper 10 is held fast to the parental bed 262.

Figure 19:
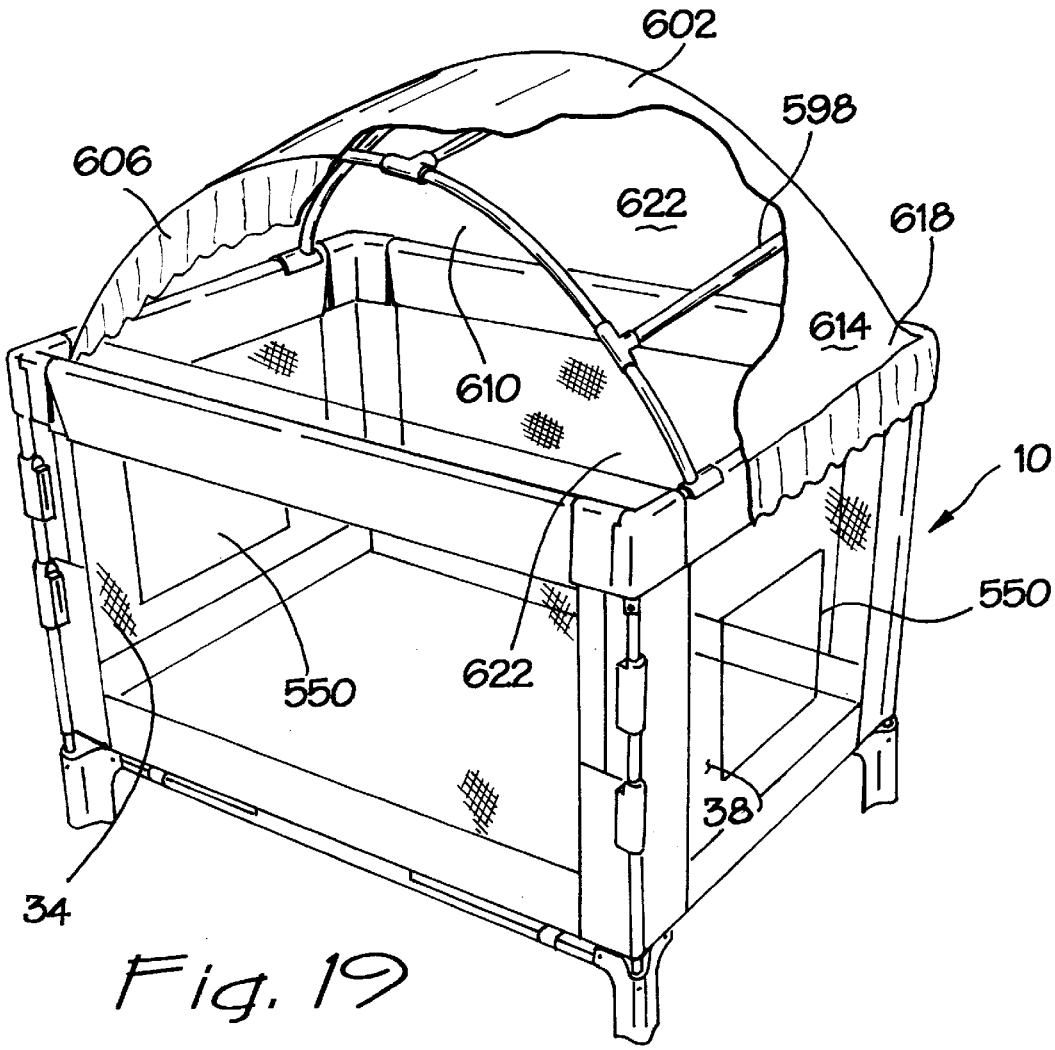
FIG. 19 is a perspective view of the co-sleeper with attached canopy cover.

In yet another variant, as illustrated in FIG. 19, the convertible playpen 10 configured as a co-sleeper further includes reversibly openable panels 550 in the first 34 and second 38 side walls.

Figure 21:
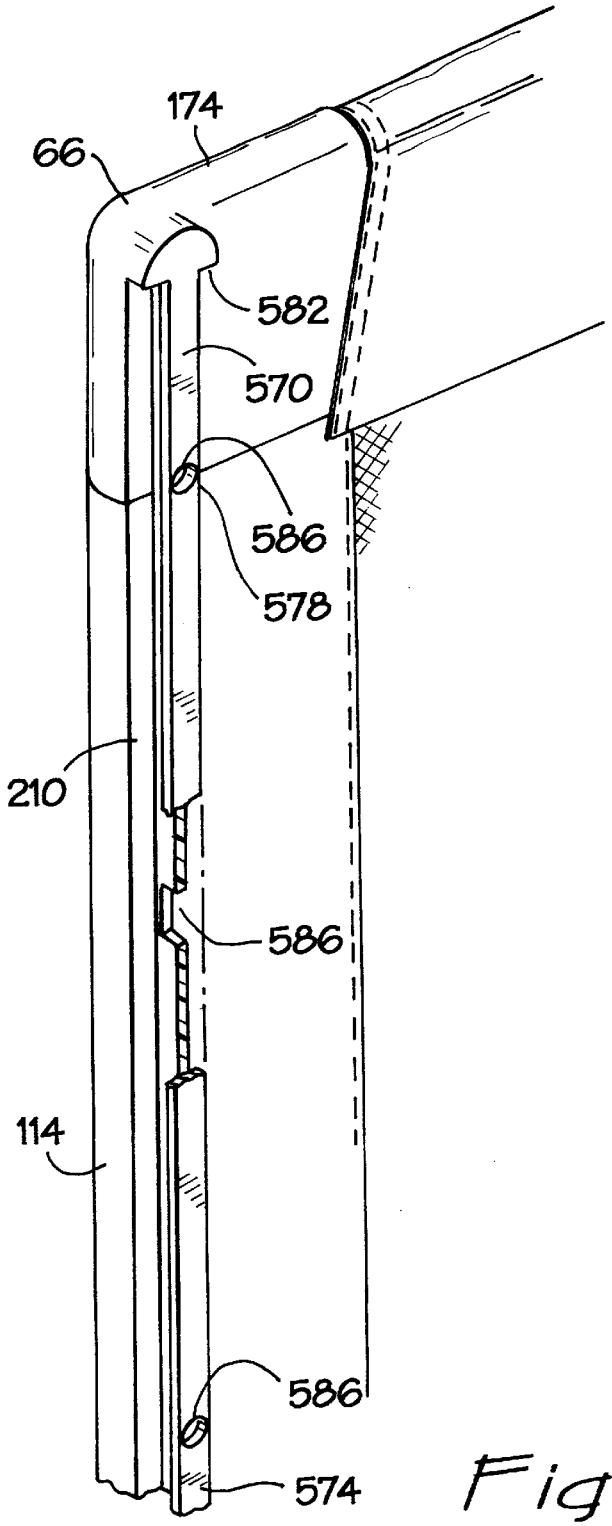
FIG. 21 is a perspective view of a second embodiment of the second section of the reversibly separable upper front corner unit.
Figure 22:
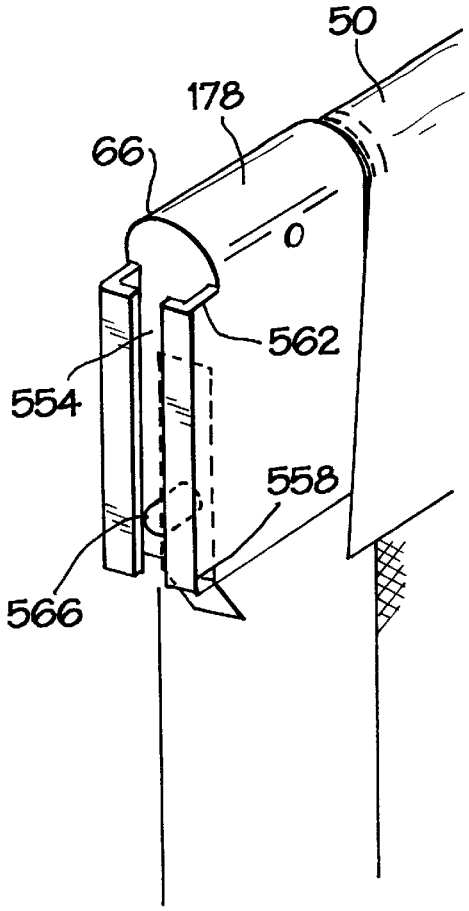
FIG. 22 is a perspective view of a second embodiment of the first section of the reversibly separable upper front corner unit.

In still another variant of the invention, as illustrated in FIGS. 21 and 22, the first 178, 182 and second 174, 186 sections of the upper front corner members 66, 70 and the receiving means 210, 214 fixedly attached to each front vertical rail 114, 118 for receiving the first section 178, 182 of the upper front corner members 66, 70 and reversibly maintaining the upper front horizontal rail 50 in at least one lower second 394 position further includes a T-shaped slot 554 extending from a lower end 558 of the first section 178, 182 of the upper front corner member 66, 70 to an upper end 562 of the first section 178, 182. An extendable locating member 566 is positioned on the first section 178, 182 adjacent the T-shaped slot 554.

A mating first T-shaped protrusion 570 extends from a lower end 574 of the receiving means 210, 214 toward an upper end 578 of the receiving means 210, 214 and into the second section 174, 186 of the upper front corner member 66, 70, terminating below an upper end 582 of the member 66, 70. At least two locating features 586 are positioned on the second section 174, 186 and the receiving means 210, 214 adjacent the first T-shaped protrusion 570. The locating features 586 are sized, shaped and positioned to be removably engaged by the extendable locating member 566 so that the first section 178, 182 of the upper front corner member 66, 70 may be secured to the second section 174, 186 and the receiving means 210, 214 in at least two positions.

In yet a further variant, as illustrated in FIG. 10, the second enclosure 222 further includes a pair of removably attached protective corner flaps 594 that are sized, shaped, and positioned to cover the receiving means 210, 214 attached to each front vertical rail 114, 118.

In still a further variant of the invention, as illustrated in FIG. 19, a canopy frame 598 is provided. The canopy frame 598 has a curved top 602, a front 606, a back 610 and is sized, shaped and positioned to removably attach to the first 58 and second 62 upper side parallel rails of the co-sleeper 10. A canopy cover is provided 614. The cover 614 is formed of flexible material 618 and is removably attached to the canopy frame 598. A mesh panel 622 is provided. The panel is sized, shaped and located to removably cover the front 606 and the back 610 of the canopy frame 598, thereby providing ventilation and protection from insects.

In yet another variant, as illustrated in FIG. 4, in which the rigid frame 46 is formed of hollow tubing, the front 50 and rear 54 upper horizontal rails each have a first portion 626 and a second portion 630. Each portion 626, 630 has an inboard end 634 and an outboard end (not shown). The frame pivoting devices 274 positioned at center points 278, 282 of the rails 50, 54 further include a connecting frame 642. The frame 642 is pivotally mounted to the inboard ends 634 of each of the first 626 and second 630 portions of the front 82 and rear 86 lower horizontal rails. The connecting frame 642 includes a pair of locking holes 646. A pair of spring-loaded buttons 650 are mounted within the upper horizontal rails 50, 54. The buttons 650 are sized, shaped and positioned to engage the locking holes 646 in the connecting frame 642 when the first 626 and second 630 portions of the rails 50, 54 are collinear. Means 654 are provided for pushing both buttons 650 inwardly so as to clear the locking holes 646 in the connecting frame 642 simultaneously, thereby permitting the lower horizontal rails 50, 54 to be pivoted upwardly.

Figures 23, 28:
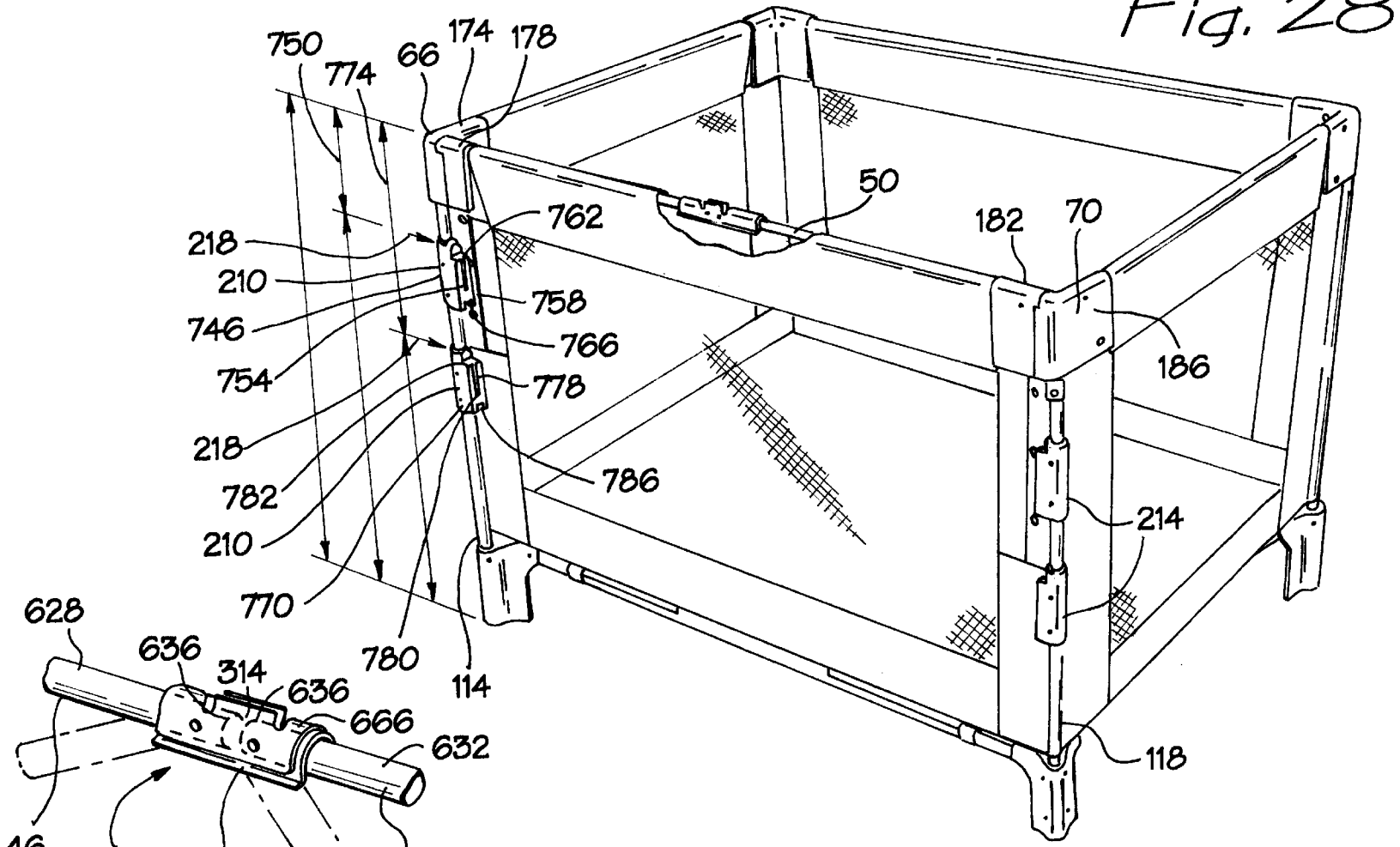
FIG. 23 is a perspective view of a second embodiment of a frame locking device.
FIG. 28 is a perspective view of the first enclosure of a second embodiment of the invention utilizing the reversibly separable corner units illustrated in FIGS. 26 and 27.

In yet another variant of the invention, as illustrated in FIG. 23, the rigid frame 46 is formed of hollow tubing and the front 82 and rear 86 lower horizontal rails each have a first portion 628 and a second portion 632. Each portion 628, 632 has an inboard end 636 and an outboard end (not shown). The frame pivoting devices 276 are positioned at center points 314, 318 of the rails 82, 86 and further include an outer connecting housing 666. The connecting housing 666 is formed of rigid material and is pivotally mounted to the inboard ends 636 of each of the first 628 and second 632 portions of the front 82 and rear 86 lower horizontal rails.

An inner spring housing 670 is provided. The spring housing 670 is pivotally mounted to the inboard ends 636 of each of the first 628 and second 632 portions of the front 82 and rear 86 lower horizontal rails such that the pivotal mountings are collinear with the mountings of the outer connecting housing 666. The inner spring housing 670 is located within the outer connecting housing 666 and is sized, shaped and positioned to fit frictionally about the inboard ends 636 of each of the first 628 and second 632 portions of the rails 82, 86. The inner spring housing 670 is capable of expanding within the outer connecting housing 666 to permit pivoting of the inboard ends 636 when the rigid frame 46 is folded, thereby providing a means of locking the inboard ends 636 in collinear alignment when the rigid frame 46 is unfolded.

In still another variant, as illustrated in FIG. 5, the rigid frame 46 is formed of hollow tubing 668. The front 82 and rear 86 lower horizontal rails each have a first portion 628 and a second 632 portion. Each portion 628, 632 has an inboard end 636 and an outboard end (not shown), and the frame pivoting devices 290 positioned at center points 314, 318 of the rails 82, 86 further include a spring housing 672. The spring housing 672 is pivotally mounted upon a pair of mounting pins 676 at the inboard ends 636 of each of the first 628 and second 632 portions of the front 82 and rear 86 lower horizontal rails. The spring housing 672 includes first 676 and second 680 pairs of arcurate alignment slots and first 684 and second 688 pairs of positioning detents.

First 692 and second 696 alignment pins are provided. The alignment pins 692, 696 are mounted parallel to the mounting pins 676 and are spaced outwardly from the inboard ends 636 of the first 628 and second 632 portions of the front 82 and rear 86 lower horizontal rails. The alignment pins 692, 696 are sized, shaped and located to fit slidably within the arcurate alignment slots 676, 680. Each of the pairs of positioning detents 684, 688 are spaced apart by a distance slightly less than a diameter 700 of one of the front 82 and rear 86 lower horizontal rails.

Figure 20:
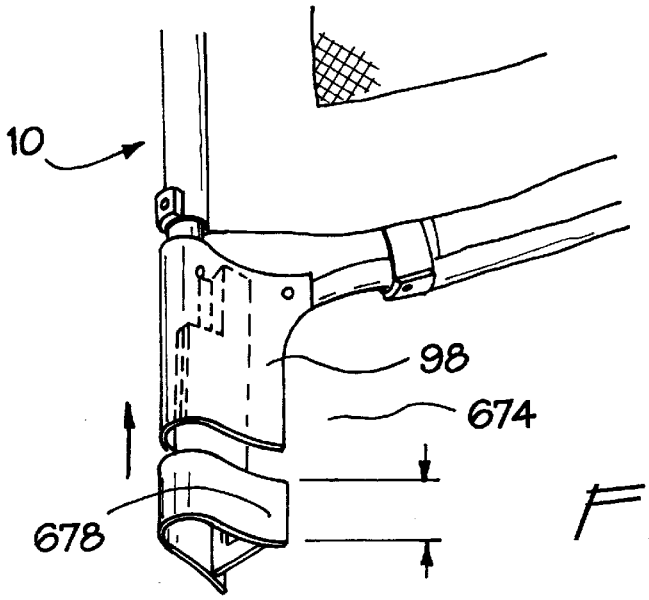
FIG. 20 is a perspective detail view of the means for changing the height of the co-sleeper.

In still a further variant, as illustrated in FIGS. 10 and 20, means 674 are provided for changing the height of the co-sleeper 10 such that the level of the front upper horizontal rail 50 when arranged in a second position 218 is substantially even with a top of the mattress 538 of the parental bed 262. In yet another variant, the height adjusting means 674 includes extensions 678 cooperating with each of the four lower corner leg members 98, 102,106,110.

In still another variant of the invention, as illustrated in FIGS. 2 and 3, the first section 178, 182 of the front upper corner member 66, 70 is a male section 682 and the second section 174, 186 is a female section 686, the second section 174, 186 having an opening sufficiently small so as to prevent entry of fingers of small children or infants.

In a further variant, as illustrated in FIGS. 6 and 10, the receiving means 210, 214 is a female section 690 for association with the male section 682. The receiving means 210, 214 has an opening sufficiently small so as to prevent the entry of small fingers of children or infants.

Figure 24:
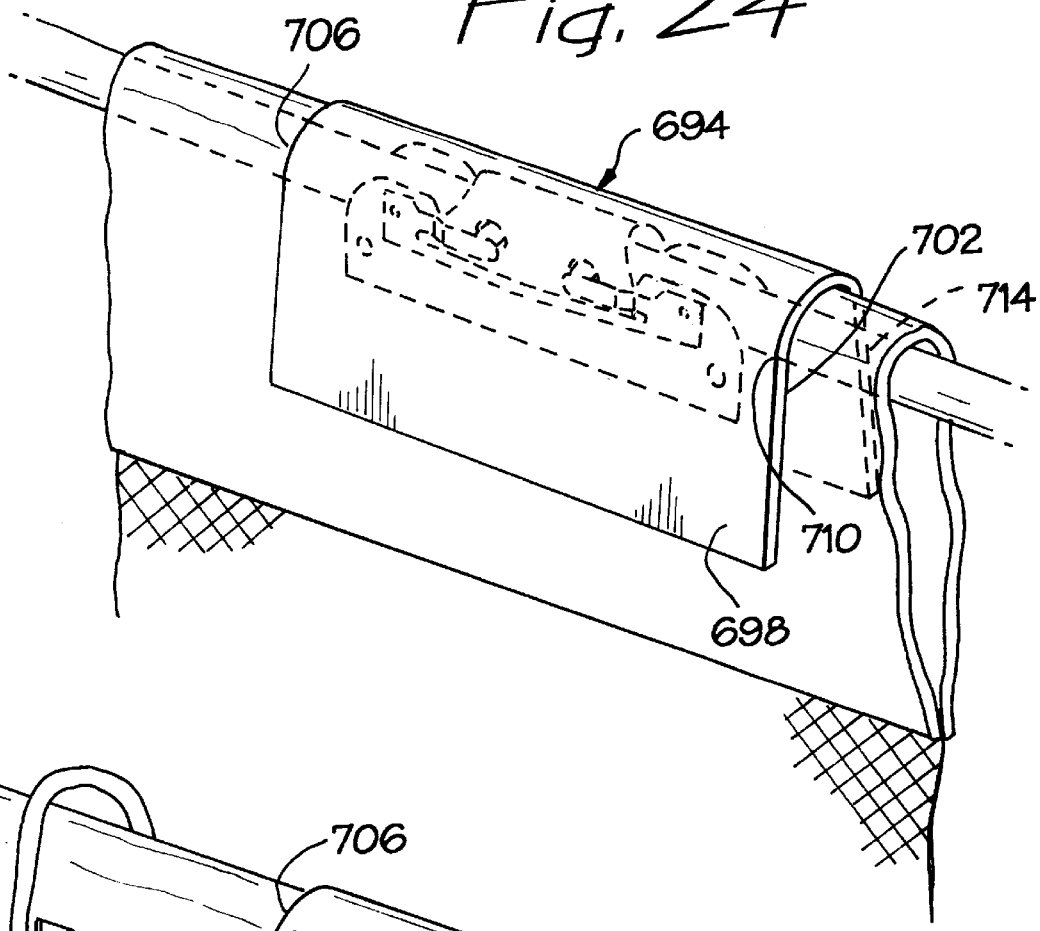
FIG. 24 is a perspective view of an add-on safety locking clip.

In yet another variant of the invention, as illustrated in FIG. 24 at least one locking safety clip 694 is provided. The locking clip 694 is formed of resilient material and includes an elongated member 698. The member 698 has a first end 702 and a second end 706. The member 698 is sized and shaped to extend past either end of one of the frame pivoting devices 290 positioned at center points 314, 318 of the front 82 and rear 86 lower horizontal rails. First 710 and second 714 rail engaging portions are provided. The first 710 and second 714 portions are fixedly attached at the first 702 and second 706 ends of the elongated member 698, respectively. The rail engaging portions 710, 714 are sized, shaped, and positioned to fit frictionally and removably over each of the front 82 and rear 86 lower horizontal rails. When the convertible playpen 10 is erected, the safety clip 694 is positioned over one of the frame pivoting devices 290 and the rail engaging portions 710, 714 are positioned on one of the front 82 and rear 86 lower horizontal rails. In this manner the rails 82, 86 will be constrained from pivoting upwardly until the safety clip 694 is removed.

Figure 25:
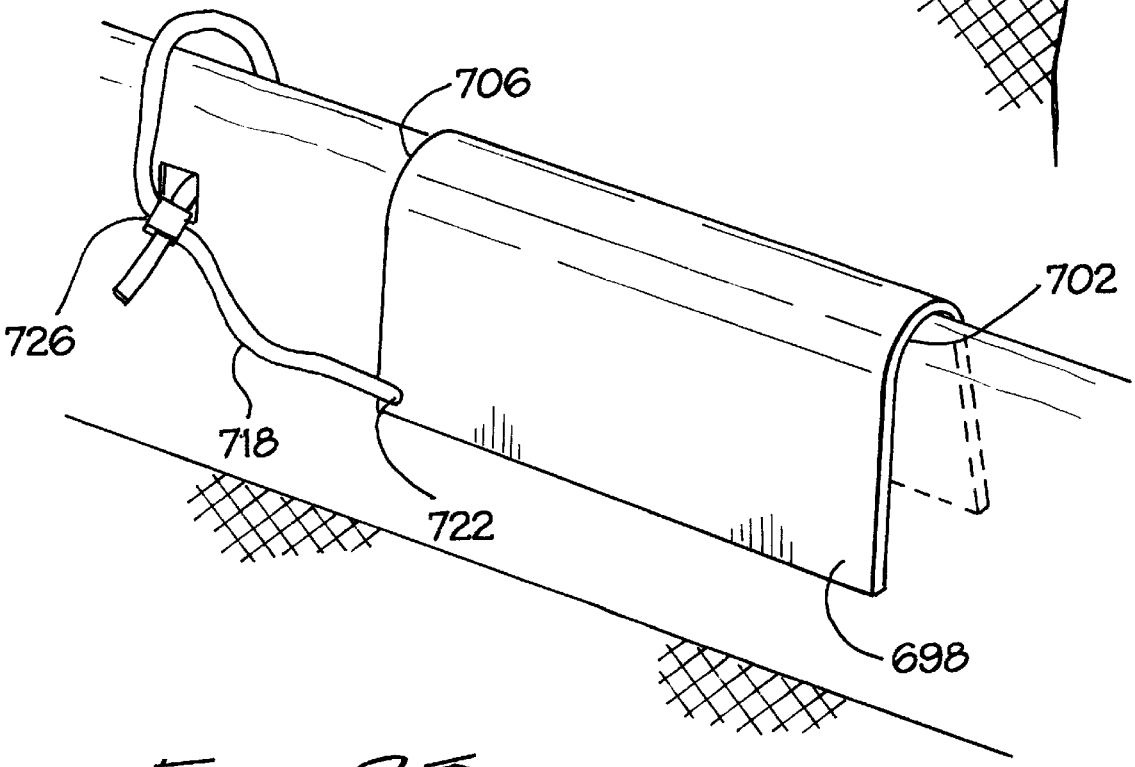
FIG. 25 is a perspective view of a flexible attaching member for an add-on safety locking clip.

In a still another variant, as illustrated in FIG. 25 the safety clip 694 further includes a flexible attaching member 718. The attaching member 718 has a first end 722 and a second end 726 and is fixedly joined at its first end 722 to the safety clip 694. The attaching member 718 has means 730 for permanently attaching to one of the front 82 and rear 86 lower horizontal rails adjacent the pivoting device 290. The means 730 is permanently joined to the attaching member 718 at its second end 726. In this manner the safety clip 694 will be constrained within close proximity of the pivoting device 290, thereby preventing its accidental loss.

Figure 26:
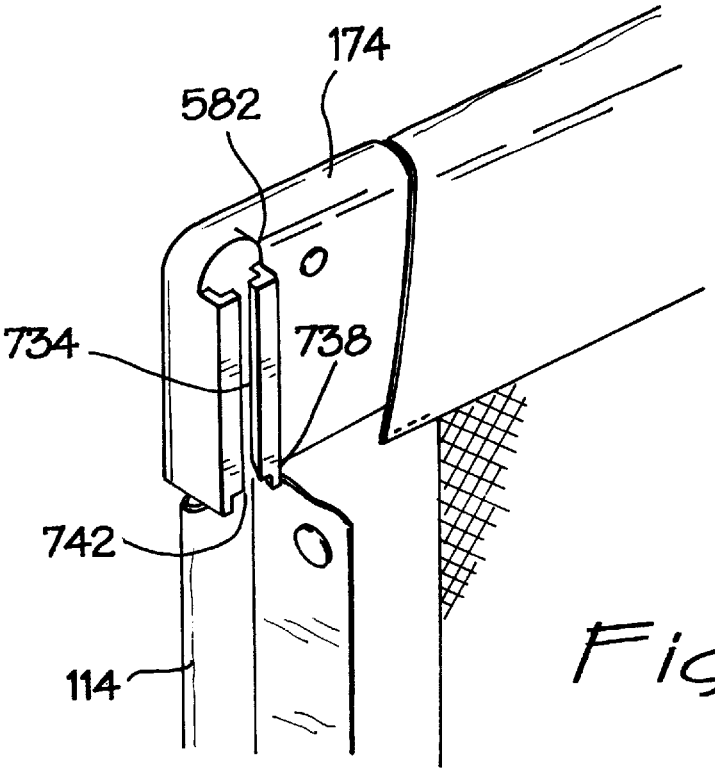
FIG. 26 is a perspective view of a third embodiment of the second section of the reversibly separable upper front corner unit.
Figure 27:
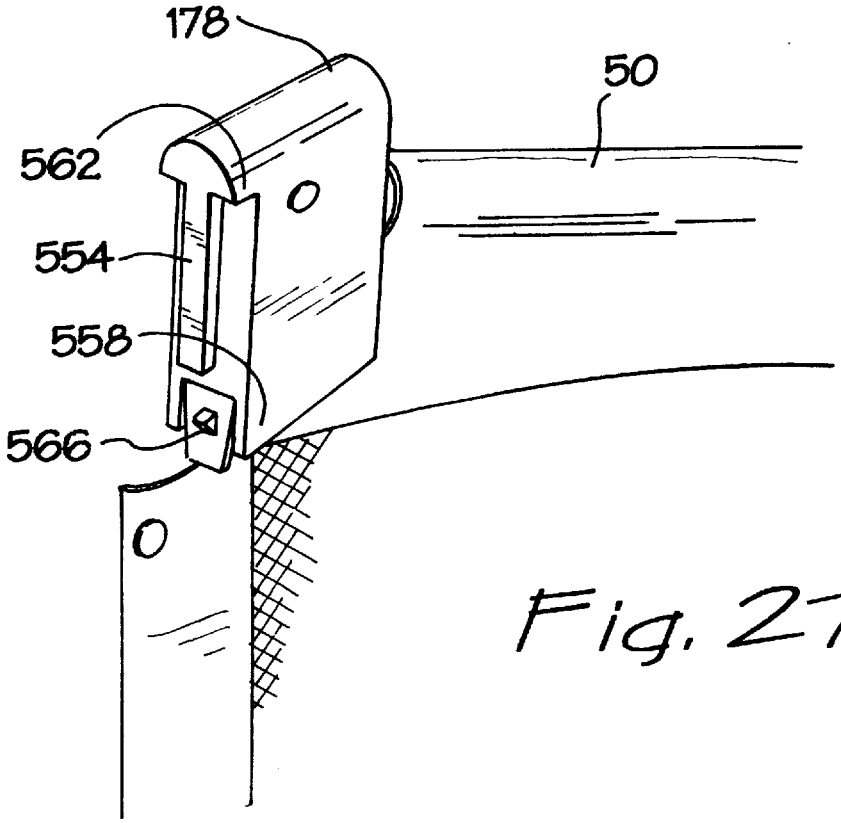
FIG. 27 is a perspective view of a third embodiment of the first section of the reversibly separable upper front corner unit.

In yet a further variant of the invention, as illustrated in FIGS. 26–28, the first 178, 182 and second sections 174, 186 of the upper front corner members 66, 70 and the receiving means 210, 214 fixedly attached to each front vertical rail 114, 118 for receiving the first section 178, 182 of the upper front corner members 66, 70 and reversibly maintaining the upper front horizontal rail 50 in at least one lower second position 218 further include a T-shaped protrusion 554 extending from a lower end 558 of the first section 178, 182 of the upper front corner member 66, 70 to an upper end 562 of the section 178, 182. An extendable locating member 566 is positioned on the first section 178, 182 adjacent the T-shaped protrusion 554. A second mating T-shaped slot 734 extends from a lower end 738 of the second section 174, 186 of the upper front corner member 66, 70 and terminates below an upper end 582 of the member 66, 70.

A first locating feature 742 is positioned on the second section 174, 186 adjacent the second T-shaped slot 734. The first locating feature 742 is sized, shaped and positioned to be removably engaged by the extendable locating member 566 so that the first section 178, 182 of the upper front corner member 66,70 may be secured to the second section 174, 186. As illustrated in FIG. 28, a first receiving portion 746 is located on the front vertical rail 114, 118 a first preset distance 750 below the second section 174, 186 of the upper front corner member 66, 70. The first portion 746 includes a third mating T-shaped slot 754 extending from a lower end 758 of the first portion 746 that terminates below an upper end 762 of the first portion 746.

A second locating feature 766 is positioned on the first portion 746 adjacent the third T-shaped slot 754. The second locating feature 766 is sized, shaped and positioned to be removably engaged by the extendable locating member 566 so that the first section 178, 182 of the upper front corner member 66, 70 may be secured to the first portion 746. A second receiving portion 770 is located on the front vertical rail 114, 118 a second preset distance 774 below the second section 174, 186 of the upper front corner member 66, 70. The second portion 770 includes a fourth mating T-shaped slot 778 extending from a lower end 780 of the second portion 770 that terminates below an upper end 782 of the second portion 770.

A third locating feature 786 is positioned on the second portion 770 adjacent the fourth T-shaped slot 778. The third locating feature 786 is sized, shaped and positioned to be removably engaged by the extendable locating member 566 so that the first section 178, 182 of the upper front corner member 66, 70 may be secured to the second portion 770.

In still another variant of the invention, as illustrated in FIGS. 2,3 and 6, the first 178,182 and second 174, 186 sections of the upper front corner members 66,70 and the receiving means 210,214 fixedly attached to each front vertical rail 114, 118 for receiving the first section 178,182 of the upper front corner members 66, 70 and reversibly maintaining the upper front horizontal rail 50 in at least one lower second position 218 further include a shortened T-shaped protrusion 788 located between a lower end 558 of the first section 178, 182 of the upper front corner member 66, 70 and an upper end 652 of the section 178,182.

An extendable locating member 566 located on the first section 178,182 below the T-shaped protrusion 788 is provided. A second mating T-shaped slot 792 extends from a lower end 738 of the second section 174, 186 of the upper front corner member 66, 70 and terminates below an upper end 582 of the member 66, 70. The slot 792 includes an opening 796 located between the upper end 582 and the lower end 738 of the member 66, 70. The opening 796 is sized and shaped to permit entry of the T-shaped protrusion 788.

A first locating feature 742 is located on the second section 174, 186 adjacent the second T-shaped slot 792. The first locating feature 742 is sized, shaped and located to be removably engaged by the extendable locating member 566 so that the first section 178,182 of the upper front corner member 66, 70 may be secured to the second section 174, 186.

As illustrated in FIG. 6, a first receiving portion 746 is provided. The first portion 746 is located on the front vertical rail 114, 118 a first preset distance 750 below the second section 174, 186 of the upper front corner member 66, 70. The first portion 746 includes a third mating T-shaped slot 800. The third slot 800 extends from a lower end 758 of the first portion 746 and terminates below an upper end 762 of the first portion 746. The T-shaped slot 800 includes an opening 796 located between the upper end 762 and the lower end 758 of the portion 746. The opening 796 is sized and shaped to permit entry of the T-shaped protrusion 788.

A second locating feature 766 is located on the first portion 746 adjacent the third T-shaped slot 800. The second locating feature 766 is sized, shaped and located to be removably engaged by the extendable locating member 566 so that the first section 178,182 of the upper front corner member 66, 70 may be secured to the first portion 746.

A second receiving portion 770 is provided. The second portion 770 is located on the front vertical rail 114, 118 a second preset distance 774 below the second section 174, 186 of the upper front corner member 66, 70. The second portion 770 includes a fourth mating T-shaped slot 804. The fourth slot 804 extends from a lower end 780 of the second portion 770 and terminates below an upper end 782 of the second portion 770. The T-shaped slot 804 includes an opening 796 located between the upper end 782 and the lower end 780 of the portion, and is sized and shaped to permit entry of the T-shaped protrusion 788.

A third locating feature 786 located on the second portion 770 adjacent the fourth T-shaped slot 804 is provided. The third locating feature 786 is sized, shaped and located to be removably engaged by the extendable locating member 566 so that the first section of the upper front corner member 66, 70 may be secured to the second portion 770.

In a final variant, as illustrated in FIG. 10, the second enclosure 222 further includes a pair of removably attached protective corner flaps 790. The flaps are sized, shaped, and located to cover the first 746 and second 770 receiving portions attached to each front vertical rail 114, 118.

While one embodiment of the present invention has been illustrated and described in detail, it is to be understood that this invention is not limited thereto and may be otherwise practiced within the scope of the following claims.

What is claimed is:

1. A playpen convertibly adapted for use as a bassinet, changing table and co-sleeper comprising:

a first rigid enclosure having an open top, a floor, a front wall, and at least one surrounding wall connected to the front wall;

said floor further comprising:

a floor panel attached to the front wall and the surrounding wall, said floor panel having a top surface and a bottom surface;

a floor reinforcing panel, said reinforcing panel having substantially the same planar dimensions as the floor panel and having an upper surface, a lower surface, a perimeter and at least four fastening portions extending outwardly from the perimeter thereof;

said reinforcing panel being fixedly attached at its upper surface to the bottom surface of the floor panel; and said fastening portions being fixedly attached to the rigid enclosure said enclosure being of a first predetermined height;

means for reversibly lowering the height of at least a portion of the front wall, from a first position at the top to at least one second position below the top, while maintaining structural rigidity of the playpen;

a second enclosure, said second enclosure being sized to fit substantially within the first enclosure and having an open top, a bottom and at least one surrounding wall;

means for removably supporting said second enclosure within the first enclosure at at least one predetermined distance from the top of the first enclosure; and a securing strap assembly for securing the playpen to a parental bed;

wherein when the front wall is in the raised first position and the second enclosure is supported by the supporting means, the playpen is usable as a bassinet; and wherein, when the front wall is then lowered to one of its second positions, the playpen is usable as a changing table; and further, when the securing strap assembly is properly positioned and the playpen is secured to the parental bed the playpen may serve as a co-sleeper.

2. A playpen convertibly adapted for use as a bassinet, changing table and co-sleeper as described in claim 1, wherein the means for removably supporting said second enclosure within the first enclosure at at least one predetermined distance from the top of the first enclosure further comprises:

first, second, third and fourth support hangers, each of said support hangers having a first end, a second end, an inner side and an outer side and having a curved hooking portion disposed at said first end;

said hooking portion being sized and shaped to fit frictionally over the first enclosure and one of the first and second upper side horizontal rails;

each of said support hangers further including at least two circular orifices, said orifices extending from the inner side to the outer side of said hangers, at least two spring button housings, said housings disposed upon the outer sides of said support hangers adjacent said orifices, each of said spring button housings including a finger opening;

two support rods, each of said rods having a first end and a second end and being sized and shaped to extend between one of the first and second support hangers and one of the third and fourth support hangers when said support hangers are disposed upon the first enclosure and one of the first and second upper side horizontal rails, each of said support rods having a spring button mounted at the first end and the second end, said spring button being sized and shaped to engage said spring button housing;

whereby, when the first and second ends of the support rods are introduced into the orifices of the support hangers, and the support hangers are disposed upon the first enclosure and one of the first and second upper side horizontal rails, the spring buttons will removably engage the spring button housings of the hangers, thereby providing a support platform for the second enclosure.

3. A playpen convertibly adapted for use as a bassinet, changing table and co-sleeper comprising:

a rigid first enclosure having an open top, a floor, a front wall, a back wall, a first side wall and a second side wall;

said enclosure being of a first predetermined height;

said enclosure having a rigid frame, said frame being formed at the top by front and rear upper parallel horizontal rails and first and second upper side horizontal rails and two upper front corner members and two upper rear corner members in cooperation therewith, and being formed adjacent the floor by front and rear lower parallel horizontal rails and first side and second side lower parallel horizontal rails and four lower corner leg members in cooperation therewith, and a pair of front vertical rails and a pair of rear vertical rails in further cooperation with the two upper front corner members and the two upper rear corner members and the four lower corner leg members;

said rigid frame supporting the floor, the front wall, the back wall, the first side wall and the second side wall;

said floor further comprising:

a floor panel attached to the front, back, first side and second side walls, said floor panel having a top surface and a bottom surface;

a floor reinforcing panel, said reinforcing panel having substantially the same planar dimensions as the floor panel and having an upper surface, a lower surface, a perimeter and at least four fastening portions extending outwardly from the perimeter thereof;

said reinforcing panel being fixedly attached at its upper surface to the bottom surface of the floor panel; and said fastening portions being fixedly attached to each of the front and rear lower parallel horizontal rails and first and second side lower parallel horizontal rails;

each upper front corner member being constructed of two reversibly separable complementary sections, the first of said sections being fixedly attached to an end of the front upper horizontal rail and the second of said sections being fixedly attached to the upper end of one of the front vertical rails, said upper front corner members supporting the upper front horizontal rail in its first position;

receiving means fixedly attached to each front vertical rail for receiving the first section of an upper front corner member and reversibly maintaining the upper front horizontal rail in at least one lower second position, thereby maintaining structural rigidity of the playpen when the upper front horizontal rail is in one of the second positions;

a second enclosure, said second enclosure being sized to fit substantially within the first enclosure and having an open top, a back wall, a front wall, first and second side walls and a bottom;

means for removably supporting said second enclosure within the first enclosure at at least one predetermined distance from the top of the first enclosure;

a securing strap assembly for securing to a parental bed;

at least one pair of alignment means through which the securing strap assembly is directed for maintaining the securing strap assembly in horizontal orientation and preventing lifting or bucking of the playpen when used as a co-sleeper; and at least one pair of attachment means for fastening the securing strap assembly to the playpen;

wherein the playpen is ready for use as a co-sleeper when the upper front horizontal rail is in one of the second positions, the second enclosure is supported by the second enclosure support means, the securing strap assembly is directed through one of the alignment means, fastened to one of the attachment means and is properly positioned and secured to the parental bed.

4. A convertible playpen as in claim 3, wherein the rigid frame further comprises:

means for pivotally mounting the front and rear upper horizontal rails to the upper front corner members and upper rear corner members, respectively;

frame locking devices positioned at center points of the front and rear upper horizontal rail pivotally mounted thereto and permitting said upper rails to pivot downwardly from the open top of the first enclosure;

means for pivotally mounting the first and second upper side horizontal rails to the upper front and rear corner members;

frame pivoting devices positioned at center points of the first and second upper side horizontal rails being pivotally mounted thereto and permitting each of said rails to pivot downwardly from the open top of the first enclosure;

means for pivotally mounting the first and second lower side horizontal rails to the lower front and rear corner members;

frame pivoting devices positioned at center points of the first and second side lower horizontal rails being pivotally mounted thereto and permitting each of said rails to pivot upwardly from the floor of the first enclosure;

means for pivotally mounting the front and rear lower horizontal rails to the lower front and rear corner members, respectively; and frame pivoting devices positioned at center points of the front and rear lower horizontal rails being pivotally mounted thereto and permitting each of said rails to pivot upwardly from the floor of the first enclosure;

wherein said frame may be quickly folded into a compact package for transport and storage by releasing the locking devices positioned on the front and rear upper horizontal rails and depressing the upper horizontal rails downwardly while pulling upwardly on a handle attached to the floor, thereby causing the upper and lower side horizontal rails and front and rear lower horizontal rails to bend upwardly and the vertical rails to move inwardly.

5. A convertible playpen as in claim 4, wherein the floor further comprises:

at least four reinforcing straps, said straps having first and second ends and being fixedly attached to the lower surface of the reinforcing panel;

two of said straps being secured at their first and second ends to each of the front and rear lower horizontal rails, respectively and two of said straps being secured at their first and second ends to each of the first and second side lower horizontal rails, respectively;

four padded covers, said covers fixedly attached to the floor panel and at least one of the fastening portions thereby protecting the frame pivoting devices attached to the front and rear lower horizontal rails and attached to the first and second side lower horizontal rails;

a flexible loop, said loop being fixedly attached to a central portion of the top surface of the floor panel, thereby providing a handle; and a hollow leg member affixed to a central portion of the lower surface of the reinforcing panel to provide support thereto.

6. A convertible playpen configured as a co-sleeper as described in claim 4 wherein the rigid frame is formed of hollow tubing, the front and rear lower horizontal rails each have a first portion and a second portion, each portion having an inboard end and an outboard end, and the frame pivoting devices positioned at center points of said rails further comprise:

a connecting frame, said frame pivotally mounted to the inboard ends of each of the first and second portions of said front and rear lower horizontal rails;

said connecting frame including a pair of locking holes;

a pair of spring-loaded buttons mounted within said lower horizontal rails, said buttons being sized, shaped and disposed to engage the locking holes in the connecting frame when the first and second portions of said rails are collinear; and means for pushing both buttons inwardly so as to clear the locking holes in the connecting frame simultaneously, thereby permitting the lower horizontal rails to be pivoted upwardly.

7. A convertible playpen configured as a co-sleeper as described in claim 6 further comprising:

means for locking the spring-loaded buttons within the horizontal rails so as to clear the locking holes in the connecting frame after pushing the buttons inwardly when the first and second portions of said rails are collinear, thereby permitting easy folding of the rigid frame; and means for unlocking the spring-loaded buttons upon folding of the rigid frame, thereby permitting the buttons to lock into the connecting frame when the rigid frame is unfolded.

8. A convertible playpen configured as a co-sleeper as described in claim 4 wherein the rigid frame is formed of hollow tubing, the front and rear lower horizontal rails each have a first portion and a second portion, each portion having an inboard end and an outboard end, and the frame pivoting devices positioned at center points of said rails further comprise:

an outer connecting housing, said connecting housing formed of rigid material and being pivotally mounted to the inboard ends of each of the first and second portions of said front and rear lower horizontal rails;

an inner spring housing, said spring housing being pivotally mounted to the inboard ends of each of the first and second portions of said front and rear lower horizontal rails such that said pivotal mountings are collinear with the mountings of the outer connecting housing; and said inner spring housing being disposed within the outer connecting housing and being sized, shaped and disposed to fit frictionally about the inboard ends of each of the first and second portions of said rails and capable of expanding within said outer connecting housing to permit pivoting of said inboard ends when the rigid frame is folded, thereby providing a means of locking said inboard ends in collinear alignment when the rigid frame is unfolded.

9. A convertible playpen configured as a co-sleeper as described in claim 4 wherein the rigid frame is formed of hollow tubing, the front and rear lower horizontal rails each have a first portion and a second portion, each portion having an inboard end and an outboard end, and the frame pivoting devices positioned at center points of said rails further comprise:

a spring housing, said spring housing being pivotally mounted upon a pair of mounting pins to the inboard ends of each of the first and second portions of said front and rear lower horizontal rails;

said spring housing including first and second pairs of arcurate alignment slots and first and second pairs of positioning detents;

first and second alignment pins, said pins being mounted parallel to said mounting pins and spaced outwardly from the inboard ends of the first and second portions of said front and rear lower horizontal rails;

said alignment pins being sized, shaped and disposed to fit slidably within said arcurate alignment slots;

each of said pairs of positioning detents spaced apart by a distance slightly less than a diameter of one of the front and rear lower horizontal rails; and whereby, when the first and second portions of said front and rear lower horizontal rails are collinear, said rails will be within said spring housing and when said rails are pivoted with respect to one another to fold the playpen, the detents will be urged against the rails by the spring resistance of the housing, causing the housing to spread apart, such resistance serving to maintain the collinear alignment of the rails when the playpen is erected.

10. A convertible playpen as described in claim 4, further comprising:

at least one locking safety clip, said locking clip being formed of resilient material and further comprising:

an elongated member, said member having a first end and a second end and being sized and shaped to extend past either end of one of the frame pivoting devices positioned at center points of the front and rear lower horizontal rails;

first and second rail engaging portions, said first and second portions being fixedly attached at the first and second ends of said elongated member, respectively;

said rail engaging portions being sized, shaped, and disposed to fit frictionally and removably over each of the front and rear lower horizontal rails; and whereby, when the convertible playpen is erected, the safety clip is positioned over one of the frame pivoting devices and the rail engaging portions are positioned on one of the front and rear lower horizontal rails, said rails will be constrained from pivoting upwardly until the safety clip is removed.

11. A convertible playpen as described in claim 10, wherein the safety clip further comprises:

a flexible attaching member, said attaching member having a first end and a second end;

said attaching member being fixedly joined at its first end to said safety clip;

said attaching member having means for permanently attaching to one of the front and rear lower horizontal rails adjacent the pivoting device, said means being permanently joined to said attaching member at its second end; and whereby the safety clip will be constrained within close proximity of the pivoting device, thereby preventing its accidental loss.

12. A convertible playpen configured as a co-sleeper as described in claim 3, wherein the second enclosure is padded and washable.

13. A convertible playpen configured as a co-sleeper as described in claim 3, wherein the second enclosure further comprises:

a removable rigid floor member being sized to fit within said second enclosure;

means for removably attaching the second enclosure to the playpen; and an elongated front flap for receiving the rigid floor member and being sized to fold over the lowered front wall and attach to the outside of the play yard, thereby preventing the formation of any pocket between the play yard and the parental bed.

14. A convertible playpen configured as a co-sleeper as described in claim 13, wherein the second enclosure further comprises a flexible floor surface.

15. A convertible playpen configured as a co-sleeper as described in claim 13, wherein the second enclosure further comprises a mesh floor surface, said surface serving to provide ventilation between the removable floor member and the second enclosure floor surface.

16. A convertible playpen configured as a co-sleeper as described in claim 15, wherein the mesh floor surface further includes reinforcing straps fixedly attached to an underside of said floor surface.

17. A convertible playpen configured as a co-sleeper as described in claim 13, wherein the removable rigid floor member has a top surface and a bottom surface and is covered with a washable fabric and padded on its top surface.

18. A convertible playpen configured as a co-sleeper as described in claim 17, wherein the removable rigid floor member is segmented into at least two segments closely aligned, is capable of being folded, and is covered with a washable fabric and padded on its top surface; said rigid floor member serving as an enclosure for the play yard when folded for transport and storage.

19. A convertible playpen configured as a co-sleeper as described in claim 18, wherein the removable rigid floor member further comprises at least one pair of reversibly separable attachment means and the second enclosure comprises a series of openings sized shaped and disposed to permit the attachment means to secure the floor member to the means for removably supporting said second enclosure.

20. A convertible playpen configured as a co-sleeper as described in claim 18, wherein the removable rigid floor member further comprises at least one pair of reversibly separable attachment means and the first and second side walls of the playpen further comprise a series of openings sized shaped and disposed to permit the attachment means to secure the floor member to the first and second side walls.

21. A convertible playpen configured as a co-sleeper as described in claim 13, further comprising:

first portions of at least two pair of reversibly separable attachment means, said first portions fixedly secured to an underside of the elongated front flap;

at least two second portions of said attachment means, said second portions fixedly secured to a portion of the front wall of the first enclosure; and whereby, when the first portions of the pair of the reversibly separable attachment means are secured to the second portions, any excessive front flap material will be secured, thereby preventing the formation of any pocket between the elongated front flap and the rigid floor member of the second enclosure.

22. A convertible playpen configured as a co-sleeper as described in claim 3, wherein height of the back wall, front wall, first and second side walls of the second enclosure may be extended from a first position to at least one second greater position, thereby permitting the bottom of said enclosure to be maintained at at least two different heights relative to a parental bed.

23. A convertible playpen configured as a co-sleeper as described in claim 22, wherein the back wall, front wall, first and second side walls of the second enclosure are formed of a flexible material and further comprising:

at least one attachment means disposed upon the back wall, front wall, first and second side walls; and said attachment means permitting material of the back wall, front wall, first and second side walls to be folded and constrained by said attachment means when the said walls are disposed in each of the first position and an intermediate position, thereby eliminating excessive loose material within the second enclosure.

24. A convertible playpen configured as a co-sleeper as described in claim 23, wherein the attachment means is a zipper having at least two mating portions.

25. A convertible playpen configured as a co-sleeper as described in claim 24, further comprising a flexible covering for the zipper portions to prevent injury to an infant or small child.

26. A convertible playpen configured as a co-sleeper as described in claim 22, wherein the second enclosure further comprises:

a first pair of reversibly separable attachment means for attaching a first side edge of the front wall to a front edge of the first side wall;

a second pair of reversibly separable attachment means for attaching a second side edge of the front wall to a front edge of the second side wall; and thereby, permitting the second enclosure to serve as a bassinet.

27. A convertible playpen configured as a co-sleeper as described in claim 26 wherein the reversibly separable attachment means comprise a pair of zippers.

28. A convertible playpen configured as a co-sleeper as described in claim 27 further comprising a pair of padded covers, said covers extending over the zippers to prevent injury to an infant or small child.

29. A convertible playpen configured as a co-sleeper as described in claim 3, wherein the front wall is formed of flexible material and further comprises means for reversibly lowering the front wall, securing any excessive flexible material, and preventing an infant or small child from becoming entrapped by openings in the front wall of the first enclosure when the upper front horizontal rail is lowered from the first, upper position to one of the second lower positions.

30. A convertible playpen configured as a co-sleeper as described in claim 29, wherein the means for reversibly lowering the front wall further comprises:

a first set of reversibly separable fasteners disposed adjacent a top edge of the front wall adjacent an intersection of the first side wall and a first side of the front wall;

a second set of reversibly separable fasteners disposed adjacent the top edge of the front wall adjacent an intersection of the second side wall and a second side of the front wall;

said reversibly separable fasteners being spaced apart by no more than two inches; and whereby, when the upper front horizontal rail is lowered from the first, upper position to one of the second lower positions, the reversibly separable fasteners may be opened as necessary to permit the front wall to be lowered while securing any excessive flexible material.

31. A convertible playpen configured as a co-sleeper as described in claim 3, wherein the second enclosure support means is sized to maintain the bottom of the second enclosure at a level at least two inches below the front horizontal rail when disposed in one of the second positions.

32. A convertible playpen configured as a co-sleeper as described in claim 3, wherein the securing strap assembly further comprises:

a strap member having a first end and a second end;

a resistance plate member having at least two slots vertically aligned and centrally disposed at which the strap member is attached such that the first end and the second end are equidistant from the plate member;

attachment cooperation means disposed at the first end and the second end of the strap member for reversible connection to one of the pairs of securing strap attachment means; and adjusting means for adjusting the length of the strap member and tightening same after connecting the attachment cooperation means to one of the pairs of security strap attachment means;

wherein, the strap member is properly positioned when disposed under a mattress and above a surface on which said mattress rests on the parental bed and held in place by the resistance plate member disposed vertically at a side of the parental bed opposite placement of the co-sleeper and the strap member is tightened so the co-sleeper is held fast to the parental bed.

33. A convertible playpen configured as a co-sleeper as described in claim 3, further comprising reversibly openable panels in the first and second side walls.

34. A convertible playpen configured as a co-sleeper as described in claim 3, wherein the first and second sections of the upper front corner members and the receiving means fixedly attached to each front vertical rail for receiving the first section of the upper front corner members and reversibly maintaining the upper front horizontal rail in at least one lower second position further comprise:

a T-shaped protrusion extending from a lower end of the first section of the upper front corner member to an upper end of said section;

an extendable locating member disposed on said first section adjacent said T-shaped protrusion;

a first mating T-shaped slot extending from a lower end of the receiving means toward an upper end of said means and into the second section of the upper front corner member and terminating below an upper end of said member;

at least two locating features disposed on said second section and said receiving means adjacent said first T-shaped slot, said locating features sized, shaped and disposed to be removably engaged by said extendable locating member so that the first section of the upper front corner member may be secured to the second section and receiving means in at least two positions; and a secure, one-way entry control disposed at the lower end of the T-shaped slot in the receiving means, said control permitting installation of the T-shaped protrusion into the first T-shaped slot and preventing easy removal therefrom.

35. A convertible playpen configured as a co-sleeper as described in claim 34, wherein the second enclosure further includes a pair of removably attached protective corner flaps, said flaps being sized, shaped, and disposed to cover the receiving means attached to each front vertical rail.

36. A convertible playpen configured as a co-sleeper as described in claim 3, further comprising:

a canopy frame, said canopy frame having a curved top, a front, a back and being sized, shaped and disposed to removably attach to the first and second upper side parallel rails of the co-sleeper;

a canopy cover, said cover being formed of flexible material and removably attached to said canopy frame; and a mesh panel, said panel being sized, shaped and disposed to removably cover the front and the back of the canopy frame, thereby providing ventilation and protection from insects.

37. A convertible playpen configured as a co-sleeper as described in claim 3, further comprising height adjusting means for changing the height of the co-sleeper such that the level of the front upper horizontal rail when disposed in a second position is substantially even with a top of a mattress of the parental bed.

38. A convertible playpen configured as a co-sleeper as described in claim 37, wherein the height adjusting means comprises extensions cooperating with each of the four lower corner leg members.

39. A convertible playpen as described in claim 3 wherein the first section of the front upper corner member is a male section and the second section is a female section, said second section having an opening sufficiently small so as to prevent entry of fingers of small children or infants.

40. A convertible playpen as described in claim 3, wherein the receiving means is a female section for association with a male section, said receiving means having an opening sufficiently small so as to prevent the entry of fingers of small children or infants.

41. A convertible playpen configured as a co-sleeper as described in claim 3, wherein the first and second sections of the upper front corner members and the receiving means fixedly attached to each front vertical rail for receiving the first section of the upper front corner members and reversibly maintaining the upper front horizontal rail in at least one lower second position further comprise:

a T-shaped protrusion extending from a lower end of the first section of the upper front corner member to an upper end of said section;

an extendable locating member disposed on said first section adjacent said T-shaped protrusion;

a mating T-shaped slot extending from a lower end the second section of the upper front corner member and terminating below an upper end of said member;

a first locating feature disposed on said second section adjacent said second T-shaped slot, said first locating feature being sized, shaped and disposed to be removably engaged by said extendable locating member so that the first section of the upper front corner member may be secured to the second section;

a first receiving portion, said first portion disposed on the front vertical rail a first preset distance below the second section of the upper front corner member and including a third mating T-shaped slot extending from a lower end of said first portion and terminating below an upper end of said first portion;

a second locating feature disposed on said first portion adjacent said third T-shaped slot, said second locating feature being sized, shaped and disposed to be removably engaged by said extendable locating member so that the first section of the upper front corner member may be secured to the first portion;

a second receiving portion, said second portion disposed on the front vertical rail a second preset distance below the second section of the upper front corner member and including a fourth mating T-shaped slot extending from a lower end of said second portion and terminating below an upper end of said second portion; and a third locating feature disposed on said second portion adjacent said fourth T-shaped slot, said third locating feature being sized, shaped and disposed to be removably engaged by said extendable locating member so that the first section of the upper front corner member may be secured to the second portion.

42. A convertible playpen configured as a co-sleeper as described in claim 3, wherein the first and second sections of the upper front corner members and the receiving means fixedly attached to each front vertical rail for receiving the first section of the upper front corner members and reversibly maintaining the upper front horizontal rail in at least one lower second position further comprise:

a shortened T-shaped protrusion disposed between a lower end of the first section of the upper front corner member and an upper end of said section;

an extendable locating member disposed on said first section below said T-shaped protrusion;

a second mating T-shaped slot extending from a lower end the second section of the upper front corner member and terminating below an upper end of said member, said slot including an opening disposed between the upper end and the lower end of said member, and being sized and shaped to permit entry of said T-shaped protrusion;

a first locating feature disposed on said second section adjacent said second T-shaped slot, said first locating feature being sized, shaped and disposed to be removably engaged by said extendable locating member so that the first section of the upper front corner member may be secured to the second section;

a first receiving portion, said first portion disposed on the front vertical rail a first preset distance below the second section of the upper front corner member and including a third mating T-shaped slot extending from a lower end of said first portion and terminating below an upper end of said first portion, said T-shaped slot including an opening disposed between the upper end and the lower end of said portion, and being sized and shaped to permit entry of said T-shaped protrusion;

a second locating feature disposed on said first portion adjacent said third T-shaped slot, said second locating feature being sized, shaped and disposed to be removably engaged by said extendable locating member so that the first section of the upper front corner member may be secured to the first portion;

a second receiving portion, said second portion disposed on the front vertical rail a second preset distance below the second section of the upper front corner member and including a fourth mating T-shaped slot extending from a lower end of said second portion and terminating below an upper end of said second portion, said T-shaped slot including an opening disposed between the upper end and the lower end of said portion, and being sized and shaped to permit entry of said T-shaped protrusion; and a third locating feature disposed on said second portion adjacent said fourth T-shaped slot, said third locating feature being sized, shaped and disposed to be removably engaged by said extendable locating member so that the first section of the upper front corner member may be secured to the second portion.

43. A convertible playpen configured as a co-sleeper as described in claim 42 wherein the second enclosure further includes two sets of removably attached protective corner flaps, said flaps being sized, shaped, and disposed to cover the second sections of the upper front corner members and the first and second receiving portions attached to each front vertical rail.

* * * * *

UNITED STATES PATENT AND TRADEMARK OFFICE

CERTIFICATE OF CORRECTION

PATENT NO. : 6,148,456
APPLICATION NO. : 09/552331
DATED : November 21, 2000
INVENTOR(S) : Douglas E. Tharalson, Diana M. Tharalson and Bruce Martin It is certified that error appears in the above-identified patent and that said Letters Patent is hereby corrected as shown below:

On the title page: Item 63 Please correct the related U.S. Application Data and Column 1, between lines 6-7, to read:

This application claims benefit under 35 U.S.C. 120 as a continuation-in-part of United States Patent Application No. 09/244,140, filed February 4, 1999 and entitled MULTI-PURPOSE BEDSIDE CO-SLEEPER, having inventors Douglas Tharalson and Diana Tharalson (subsequently issued as United States Patent No. 6,112,347 on September 5, 2000); which in turn claims priority to PCT Application PCT/US97/15282, entitled Multiple-Purpose Convertible Playpen, having inventors Douglas E. Tharalson and Diana M. Tharalson, and designating the United States; which in turn claims priority to United States Patent No. 5,845,349, entitled MULTIPLE PURPOSE CONVERTIBLE PLAYPEN and having inventors Douglas E. Tharalson and Diana M. Tharalson.

Signed and Sealed this

Twelfth Day of June, 2007

JON W. DUDAS
*Director of the United States Patent and Trademark Office*